United States Patent [19]

Lombardi et al.

[11] 3,977,216

[45] Aug. 31, 1976

[54] KNITTING MACHINES AND METHODS FOR KNITTING FABRICS HAVING TERRY LOOPS ON BOTH SIDES THEREOF

[75] Inventors: Victor J. Lombardi, Burlington, N.C.; Jose Ma Dalmau, Barcelona, Spain

[73] Assignee: Jumberca, S.A., Barcelona, Spain; a part interest

[22] Filed: Apr. 21, 1975

[21] Appl. No.: 569,742

[52] U.S. Cl. ..... 66/111; 66/121; 66/104; 66/107; 66/194

[51] Int. Cl.[2] ..... D04B 15/08

[58] Field of Search ..... 66/121, 104, 122, 107, 66/123, 108, 111, 90, 93

[56] References Cited

UNITED STATES PATENTS

| | | | |
|---|---|---|---|
| 1,065,896 | 11/1920 | Lawson | 66/107 |
| 1,764,406 | 6/1930 | Hohmann | 66/121 |
| 1,780,790 | 11/1930 | Leavin et al. | 66/121 |
| 1,886,291 | 11/1932 | Mills | 66/121 |
| 2,204,606 | 6/1940 | Lucas | 66/121 X |
| 2,216,099 | 9/1940 | Lucas | 66/121 X |
| 2,662,383 | 12/1953 | Lombardi | 66/107 X |
| 3,293,887 | 12/1966 | Crawford | 66/108 |
| 3,877,258 | 4/1975 | Uhlir | 66/107 X |

FOREIGN PATENTS OR APPLICATIONS

| | | | |
|---|---|---|---|
| 12,490 | 2/1881 | Germany | 66/121 |
| 5,518 | 10/1878 | Germany | 66/121 |

*Primary Examiner*—Ronald Feldbaum
*Attorney, Agent, or Firm*—Cushman, Darby & Cushman

[57] ABSTRACT

The invention comprises an improved apparatus and method for producing knit fabrics having terry loops on both the technical front and technical back sides of a ground fabric in which the terry loops are interconnected or knitted jointly with the ground yarn into the base fabric and are thus securely held therein. Novel needle latch arresting elements and improved sinker designs eliminate severing of previously formed loops incorporated in the ground fabric.

28 Claims, 62 Drawing Figures

Fig. 8.
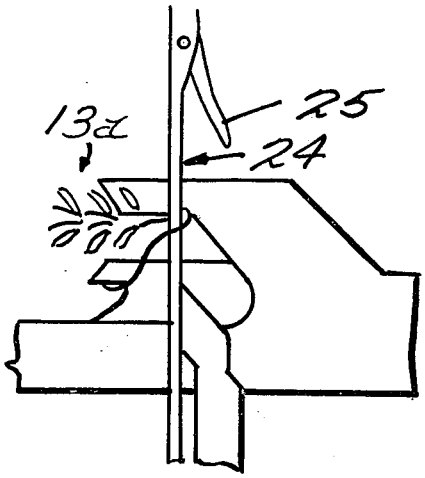
Fig. 9.
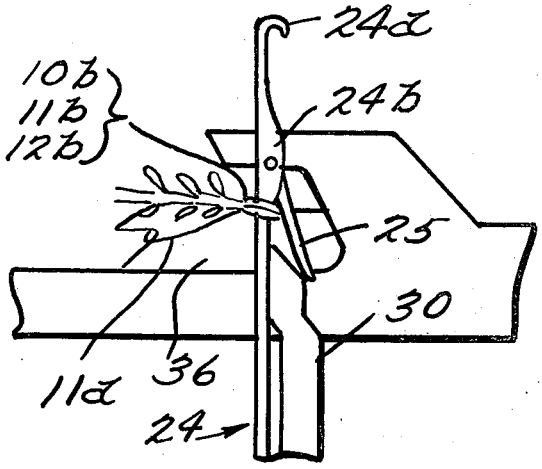
Fig. 10.
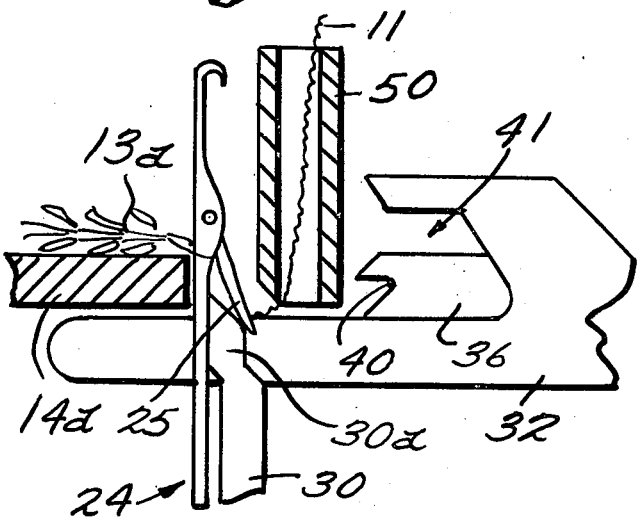
Fig. 11.
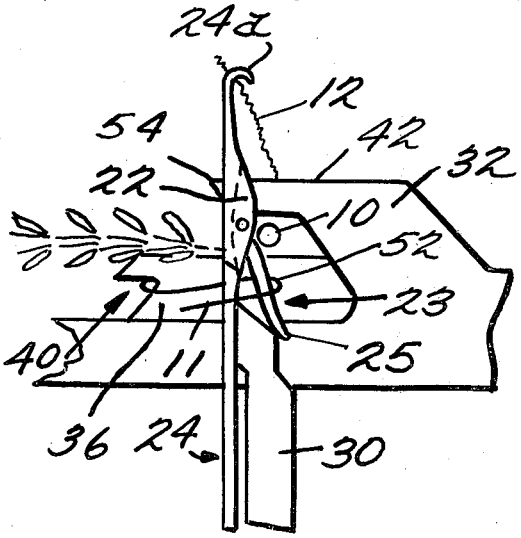
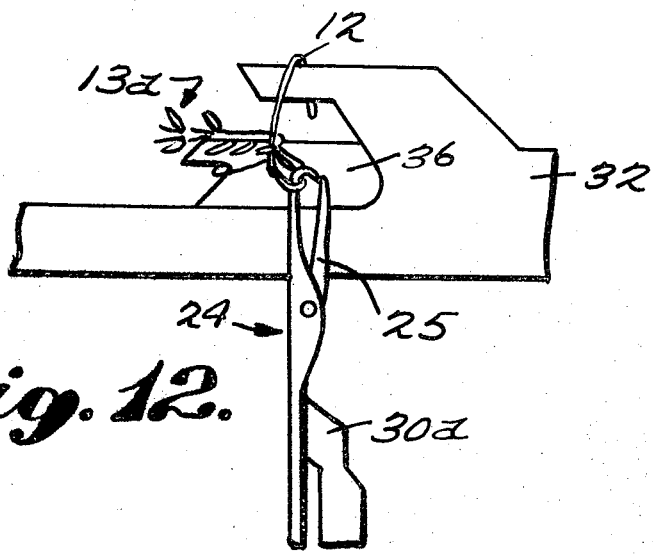
Fig. 12.

Fig. 19.
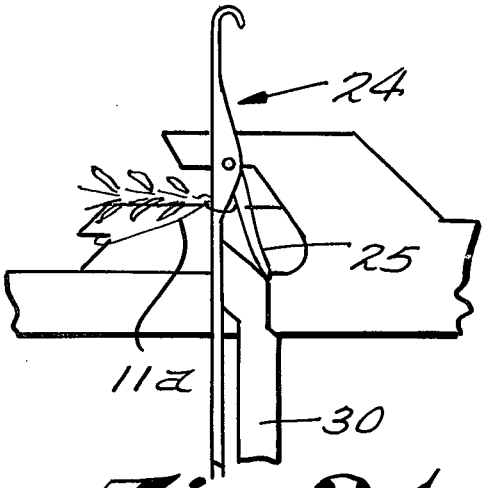
Fig. 20.
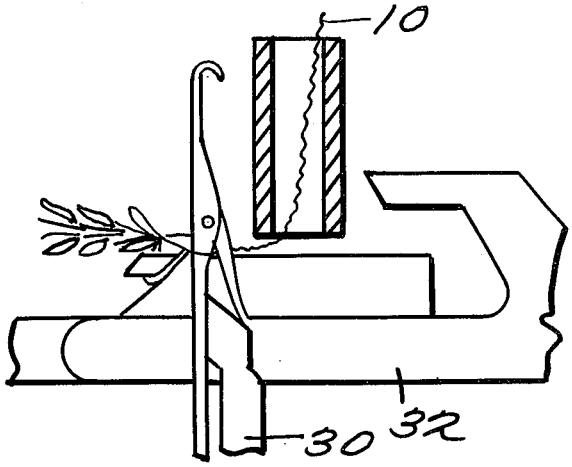
Fig. 21.
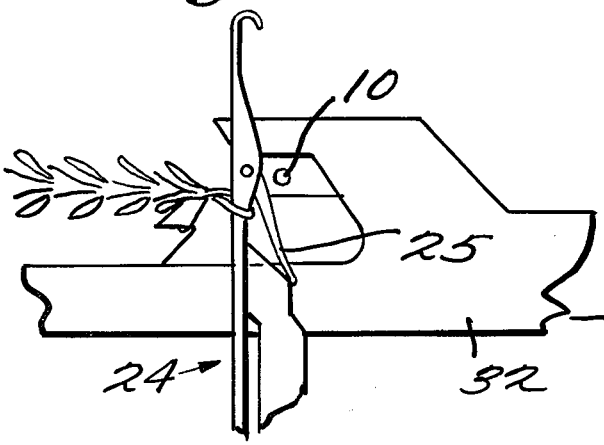
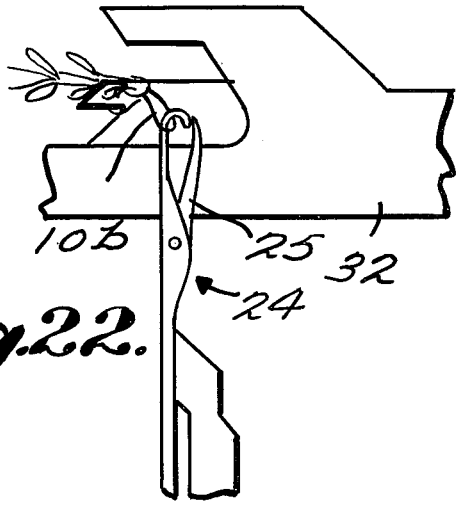
Fig. 22.
Fig. 24.
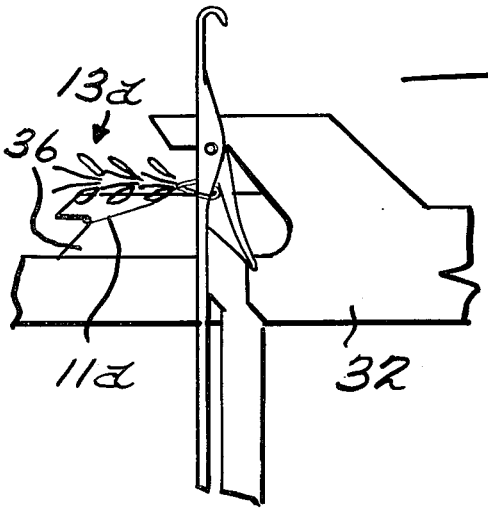
Fig. 23.
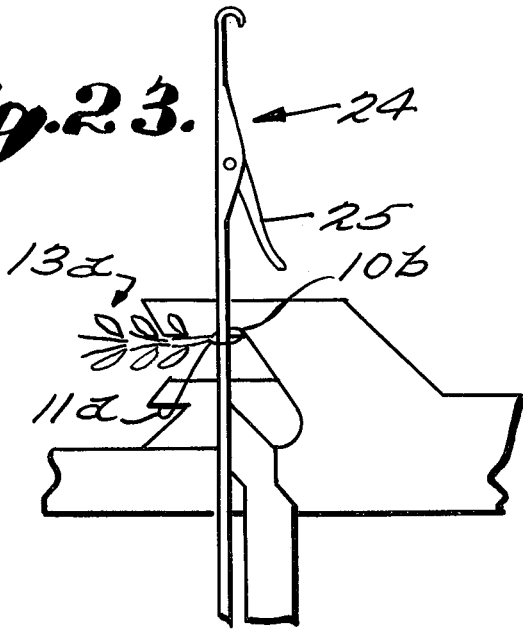

71
74
71a
110
111
124a
124
113
119

113
72

120
110
31
119
124a
124
111a
111
72
31
113

46a
44
110
71
74
119
71a
71b
73
71c
72
71d
113
114

Fig. 32.
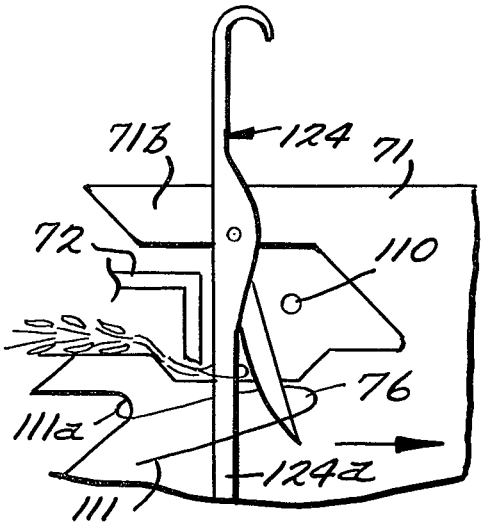
Fig. 33.
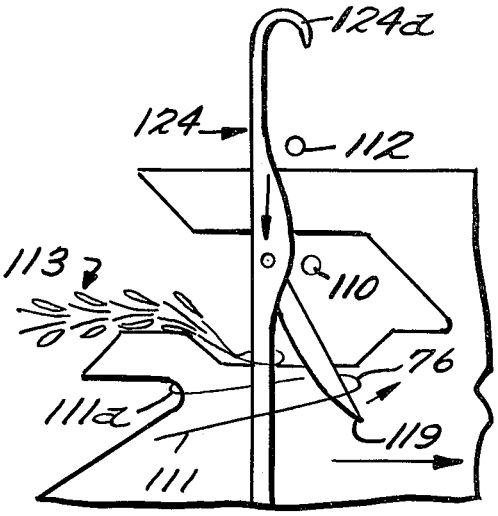
Fig. 34.
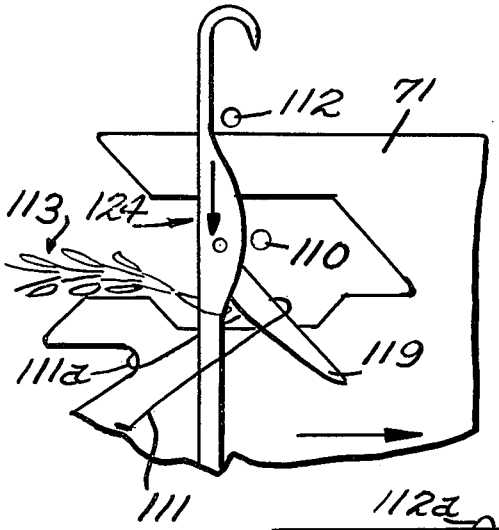
Fig. 35.
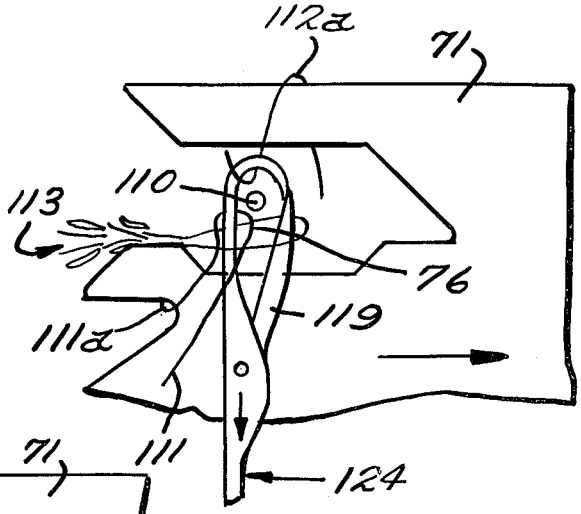
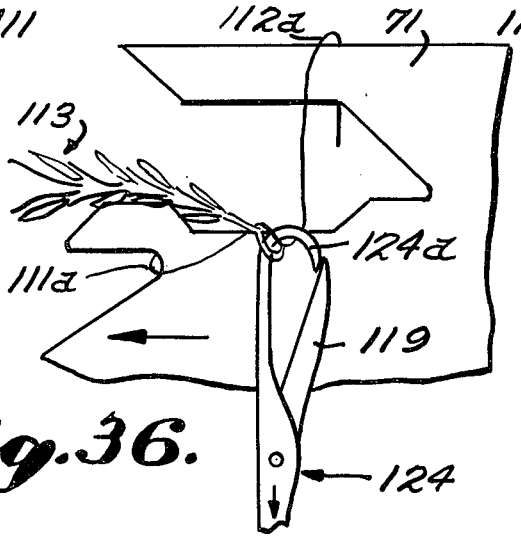
Fig. 36.

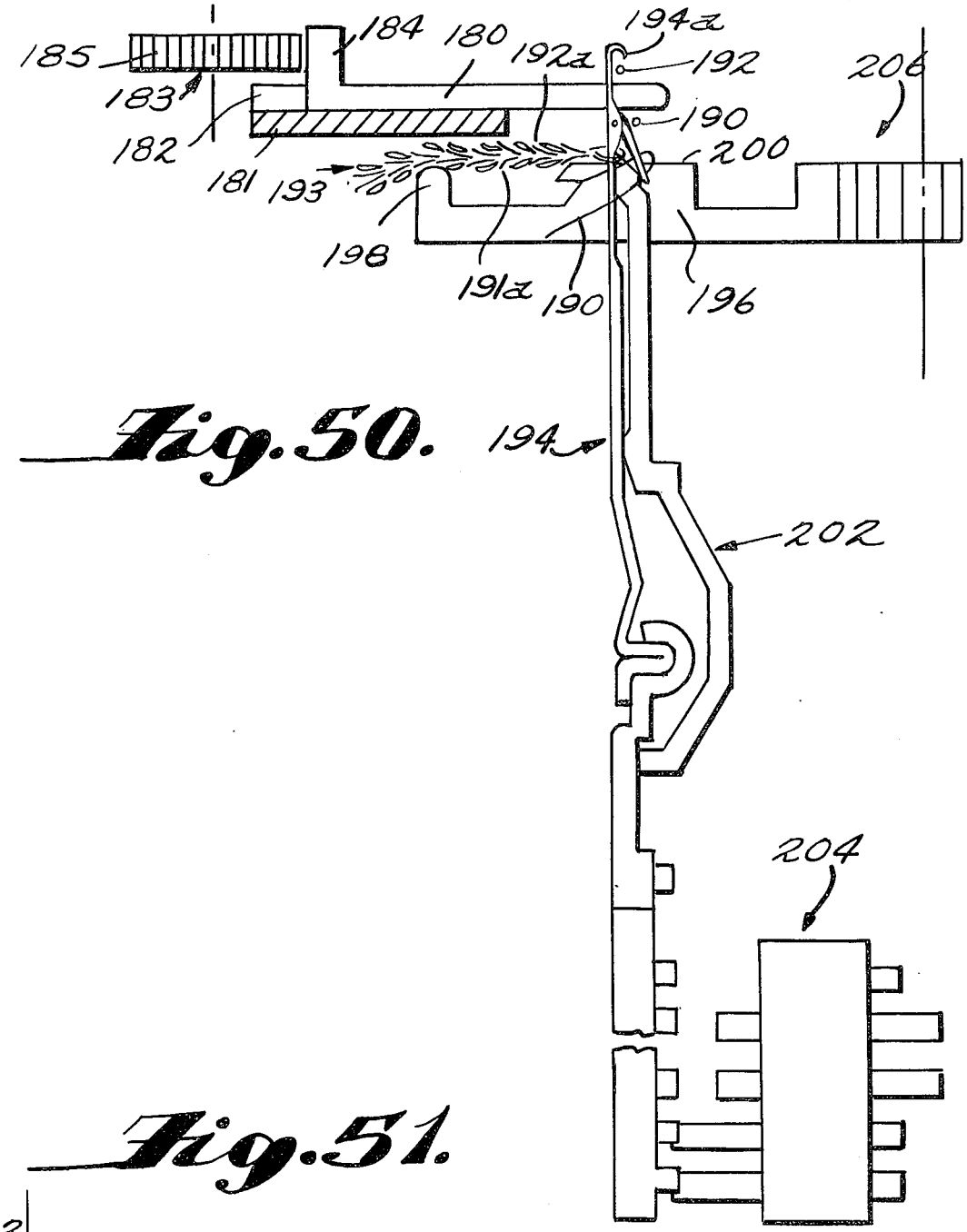
Fig. 50.
Fig. 51.
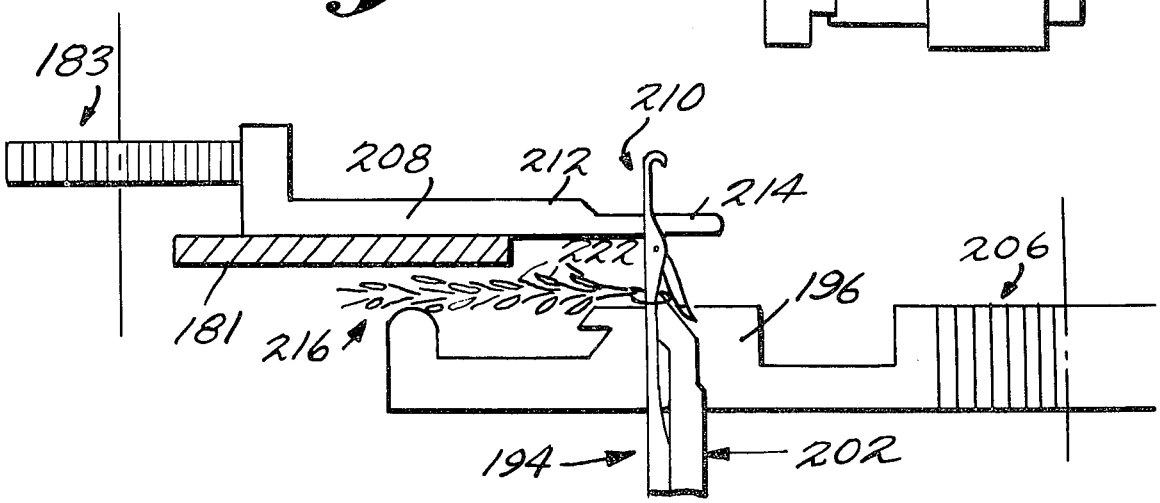

Fig. 52.
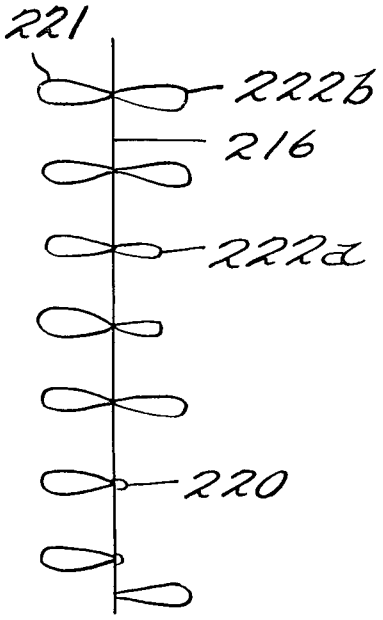
Fig. 53.
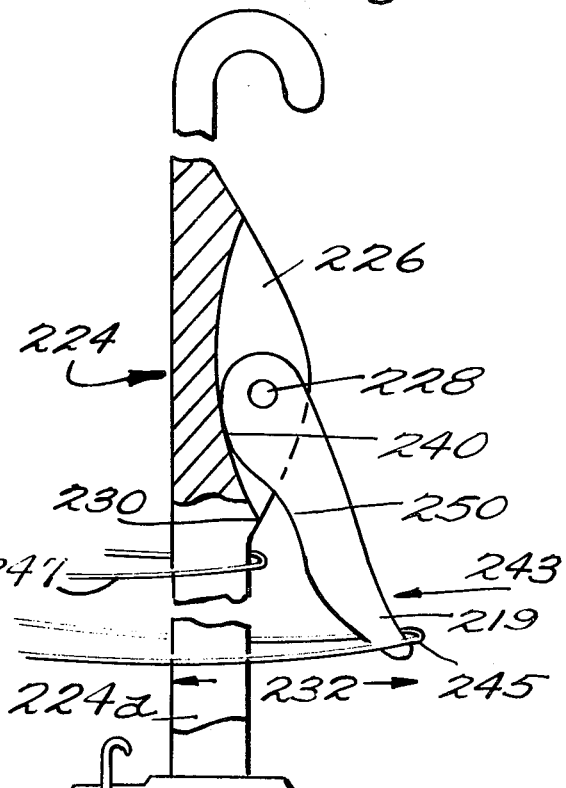
Fig. 54.
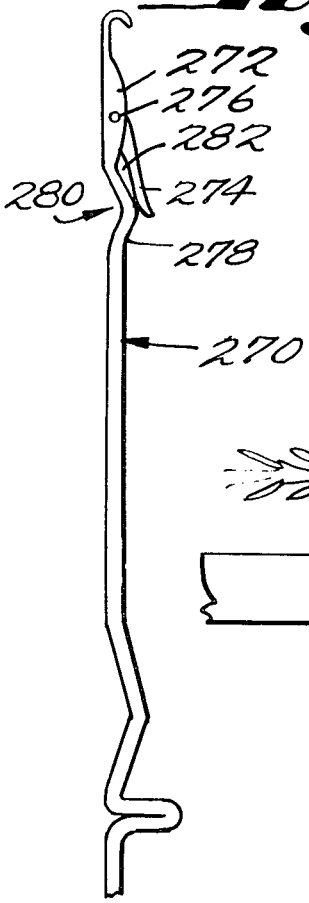
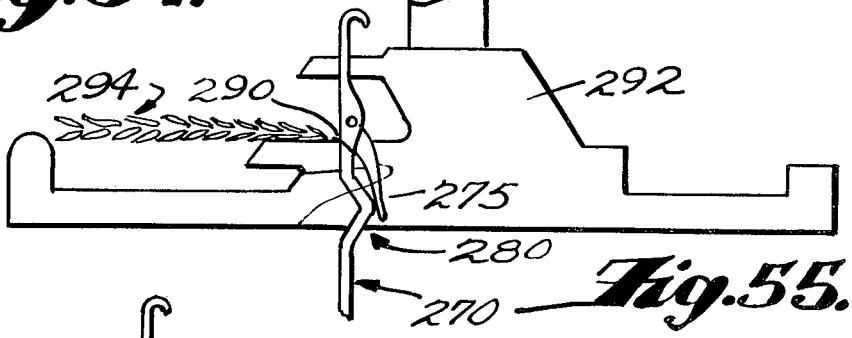
Fig. 55.
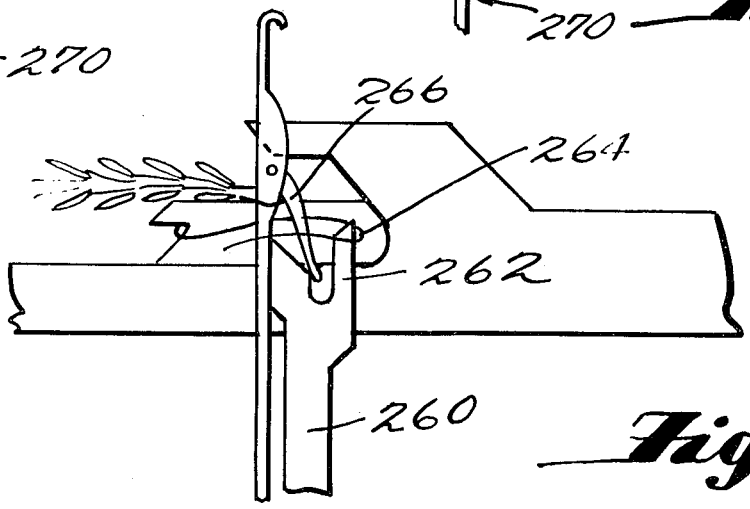
Fig. 56.

KNITTING MACHINES AND METHODS FOR KNITTING FABRICS HAVING TERRY LOOPS ON BOTH SIDES THEREOF

This invention relates to improvements in knitting machines and more particularly to circular knitting machines, knitting elements, and methods for knitting single jersey fabrics wherein terry loops are made to appear on the technical front face of the fabric, alone, or in combination with terry loops on the technical back face of the fabric. The invention contemplates the formation of terry loops which are knitted jointly with a ground yarn into the base or ground fabric and thus securely anchored in the knitted construction.

It is well known in the knitting art to form terry loops on the technical reverse or back side of the fabric with such loops knitted simultaneously into the fabric with a so-called ground yarn. This has been and continues to be a successful and simply accomplished method for producing single face terry loop fabric. When sheared, this fabric forms the basic for the widely accepted knitted velour.

There are also described in the prior art knitting machines, methods, and knitting elements, such as sinkers, for forming terry loops on the technical face of the fabric; these, for example, in combination with terry loops on the back side thereof, are described in Lombardi U.S. Pat Nos. 2,774,233 and 2,893,226.

The prior art also teaches that the so-called front terry loops can readily be incorporated in a fabric in a so-called non-knit manner. That is to say, they do not constitute knitted loops in the ground construction, but rather are tied into the base fabric in a loosely-held manner. Because of this, they are not firmly secured and thus, can be easily pulled free from the ground construction.

Examples of this are shown in FIG. 1 of McAdams 1,949,319 and in FIG. 1 of Lombardi U.S. Pat. No. 2,774,233 which show a terry loop fabric wherein terry loops of uniform height are formed on both faces of a base fabric. Neither terry loop yarn is knit into the base fabric at every stitch and is thus not held. At least portions of the terry loops can be pulled free from the base fabric which is undersirable. Likewise, Thibord et al., U.S. Pat. No 2,936,601 discloses circular knitting machines for producing terry loop fabric having terry loops on both sides thereof in which the front terry loop is incorporated into the fabric in an unknit manner.

It will be apparent, too, that inasmuch as these terry loops extend well above the ground or base fabric, they are very susceptible to snagging, pulling, and similar problems. These shortcomings have greatly minimized the terry loop fabric's utility and seriously interfere with its commercial acceptance.

Although the prior art in Lombardi U.S. Pat. No. 2,893,226, as illustrated in FIGS. 38 and 40 through 44, also describes machines, methods and sinker elements for producing terry loop fabric having terry loops on both front and back surfaces and in which the front loop yarn as well as the back loop yarn are interknitted with a so-called ground yarn, we have found certain problems in this approach which detrimentally affected the knitting of such double terry loop constructions on a fault-free commercial basis.

In addition to the above patents, applicants are aware of the following patents:

R. K. Mills U.S. Pat. No. 1,884,090
R. K. Mills U.S. Pat. No. 1,886,291

R. K. Mills U.S. Pat. No. 1,997,530
Williams U.S. Pat. No. 1,163,296
Nebel U.S. Pat. No. 2,080,337
Lombardi U.S. Pat. No. 3,561,441

The Mills U.S. Pat. Nos. 1,884,090 and 1,997,530 show specific needle constructions in which the milled slots define arcuate surfaces, whose bottom-most portions provide seating or stop positions for the pivot latches when fully opened. In these fully opened positions, spaces are provided between the latches and the juxtaposed needle stem in a manner long established in knitting art.

In Mills U.S. Pat. No. 1,997,530, furthermore, the latch has been formed to create increased clearance between the latch itself and the needle cheeks to prevent the possibility of scissoring of the loop or yarn when the latch closes during retraction of the needle. This preventive action occurs at a position between the needle hook and above the latch pivot point and not below the pivot point.

Mills U.S. Pat. No. 1,886,291 illustrates the use of a recess formed in the shank of the needle below the latch, and the recess provides space into which the tip end of the latch can enter. This is necessary to insure that the tip of the latch is buried in the recess well below the surface of the shank so that when the needle is retracted, the previously formed loop can pass over the depressed latch tip to again occupy a position on the needle latch. The expressed purpose in the needle construction in Mills U.S. Pat. No. 1,886,291 is to permit this knitting step to lock-in the loop thus rendering the fabric non-run.

There is no recognition in any of the Mills patents of raising previously formed loops toward the pivot point of a latch, nor that those loops would be severed during the opening of that latch because of the scissoring action occurring between the latch and the cheeks of the needle. Further there is no teaching of using a latch arresting means which is controllably moved in a coordinated fashion with the needle, controlling the opening of the latch in a timed relationship with the feeding of yarns so as to prevent cutting of previously formed base fabric loops retained on the needle stem.

Therefore, the use of needles disclosed by Mills would not prevent the yarn severing problem discussed herein since movement of loops up the needle stem to the pivot point can occur and would place the previously formed base fabric loops within the pivot range of the latches so that severing could occur long before the needle latch was fully opened. Since in the present invention it is important that the previously formed loops be moved upwardly or the needle stem and below the latch toward the cheeks of the needle, use of any of the Mills needles would could not be used to prevent severing problems.

The Williams patent discloses the use of a jack member, the object of which is to protect the latch against breakage should unyielding obstacles lie between the latch and the needle stem. A second object is the initial opening of the latch from its fully closed position. There is no indication or disclosure within Williams as to the functioning of the jack member which relates to the present invention and in the retracted position the jack in Williams does no more than the lower portion of the milled slot in the Mills needles.

The Nebel patent discloses a sinker arrangement used in making plush loop materials. One embodiment, FIGS. 19 and 21, discloses a modified sinker in order to produce either loose or tightly knit fabric. The fabric being knit, however, has loops only on the technical backside of the fabric and there is no discussion of using the type of sinker shown in FIG. 21, either by itself or in conjunction with any other means or as the sinkers of the present invention are used. Likewise there is no disclosure of any coordination between the needle and the sinker in the arrangement shown in FIG. 21.

Lombardi U.S. Pat. No. 3,561,441 discloses a double-loop fabric in which the loops on one face are of differing heights. The methods as set forth in the present invention, however, differ from the method of producing this fabric as will be pointed out hereinafter.

To form front terry loops in a circular knit fabric, it is necessary to provide means for lifting the fabric web sufficiently high on the needles to permit the introduction of a front loop yarn below the level to which the web is elevated. The web may be lifted to this level by appropriate extensions or protuberances on the sinkers and/or needles, or by elevated portions at the uppermost end of the cylinder as described in the Lombardi U.S. Pat. No. 2,893,226.

It has been found relatively simple to introduce a front loop yarn into the throat of a sinker at a level below the fabric web and below the bottom-most portion of the needle latch in its fully opened position, and to form that front loop yarn into a front terry loop by actuating sinker means to a position inwardly of the circle of needles. Such introduction makes no unnecessary demands on the knitting function inasmuch as the front loop yarn so introduced cannot be formed into a knitted loop securely held in the base fabric.

However, in order to knit a front loop yarn into the base fabric with a ground yarn, or in combination with the ground yarn and the so-called back loop yarn, it is necessary that the front loop yarn be introduced on the latch of the needle and not below. In this way, the front loop yarn may be formed into a knitted loop by being pulled through the previously formed loops retained on the needle stem which form the fabric web. This procedure, although described in Lombardi U.S. Pat. No. 2,893,226, has not been possible of commercial attainment because of knitting difficulties which developed in the practice of that invention.

More specifically, it was noted that in order to form a knitted loop in the ground fabric with the so-called front loop yarn, it is necessary to introduced this yarn through sinker means on the latch of the needle and still below the fabric web. Inasmuch as the fabric web has to be maintained at a raised level on the cheeks of the needle in order to permit the introduction of the front loop yarn on the needle latch and yet below the web, the force exerted on the latch by the front loop yarn when it is kinked by the sinkers as they advance inwardly creates great pressure on the previously formed loops which constitute the web of the base or ground fabric and which occupy a position between the needle cheeks and the latch due to their raised position. We have found this pressure to be sufficiently great so as to produce a scissoring action between the needle cheeks and the needle latch, thereby cutting the previously formed loops of the fabric which are tautly held below the latch at the point of intersection between the needle cheeks and their cooperating needle latch.

Accordingly, the present invention contemplates means to overcome the difficulties encountered with previous prior art approaches.

It is, therefore, one objective of this invention to provide means and methods whereby the scissoring of previously formed loops in the web is eliminated.

It is a further objective of the invention to provide specially formed knitting instrumentalities either of single or two-part construction to eliminate the tension generated on the previously formed loops when the front loop yarn is pressed against the latch of the needle.

It is a further objective of the invention to provide sinkers of appropriate design either of two-part or single-part construction for forming the knitted-in terry loops of this invention.

It is a further objective of the invention to provide sinker means comprising two separate elements mounted in the same slot of a sinker dial, said sinker means being independently operable for forming so-called back terry loops and so-called front terry loops in a fabric of double terry loop construction.

It is a further objective of the invention to provide suitable means for actuating independently the front terry loop and the back terry loop forming elements.

It is a further objective of the invention to provide means for knitting the front loop and the back loop yarns with a ground yarn at successive knitting positions on the machine.

It is a further objective of the invention to provide cam means whereby at one feed a so-called ground yarn is interknitted with both a front loop yarn and a back loop yarn, and at a following feed where the front terry loop knitted at the previous feed is reformed and only the ground yarn is introduced.

It is a further objective of the invention to provide means for selectively actuating the loop-forming elements when such elements constitute single sinker means, and to provide selecting means independently operable when such sinker means comprises two cooperating sinker elements mounted for relative motion in a slot in a sinker dial member extending outwardly of the circle of needles.

It is a further objective of the invention to provide jack element means in an inner dial member for forming the so-called back terry loops independently of the front terry loops which are formed with sinker means mounted in an outwardly extending dial member.

It is a further objective of the invention to provide adjustable means in said inner dial member so that back terry loops of different height can be readily obtained by raising or lowering the inner dial member.

It is a further objective of the invention to provide the inner dial jack element with at least two levels at its outer extremity such that terry loops of different heights can be formed on the technical back side of the fabric by the outward positioning of the dial jack member, said back terry loops being formed in combination with front terry loops.

It is a further objective of the invention to provide means for selective advancement of the dial jack elements so that back terry loops can be formed over a lower surface or higher surface of the dial jack element, with said back terry loops formed in combination with front terry loops.

These and additional features and advantages of the present invention will be discussed in greater detail below. Reference will be made to the accompanying drawings, as follows:

BRIEF DESCRIPTION OF THE DRAWINGS

FIG. 8 is a diagrammatic view illustrating a step in the formation of a double terry loop fabric in the practice of the present invention;

FIG. 9 shows a later step;

FIG. 10 shows a later step;

FIG. 11 shows a later step;

FIG. 12 shows a later step;

FIG. 19 is a diagrammatic view illustrating an alternate step in the formation of terry loop fabric in the practice of the present invention;

FIG. 20 shows a later step;

FIG. 21 shows a later step;

FIG. 22 shows a later step;

FIG. 23 shows a later step.

FIG. 24 shows a later step;

FIG. 32 shows a later step;

FIG. 33 shows a later step;

FIG. 34 shows a later step;

FIG. 35 shows a later step;

FIG. 36 shows a later step;

FIG. 50 is a diagrammatic view illustrating another embodiment of the invention wherein the back loop-forming element is mounted in an inner dial member;

FIG. 51 illustrates an alternate form of the dial jack of FIG. 50;

FIG. 52 is a side view of one form of double terry loop fabric knitted with the alternate means of FIG. 51;

FIG. 53 illustrates a side view of an alternate knitting needle used in the practice of the present invention;

FIG. 54 illustrates another alternate needle;

FIG. 55 is a diagrammatic view of the needle of FIG. 53 in combination with sinker loop-forming means; and FIG. 56 is a diagrammatic view of alternate needle jack means in combination with a two-component sinker means.

DETAILED DESCRIPTION OF THE INVENTION

Figure 1:
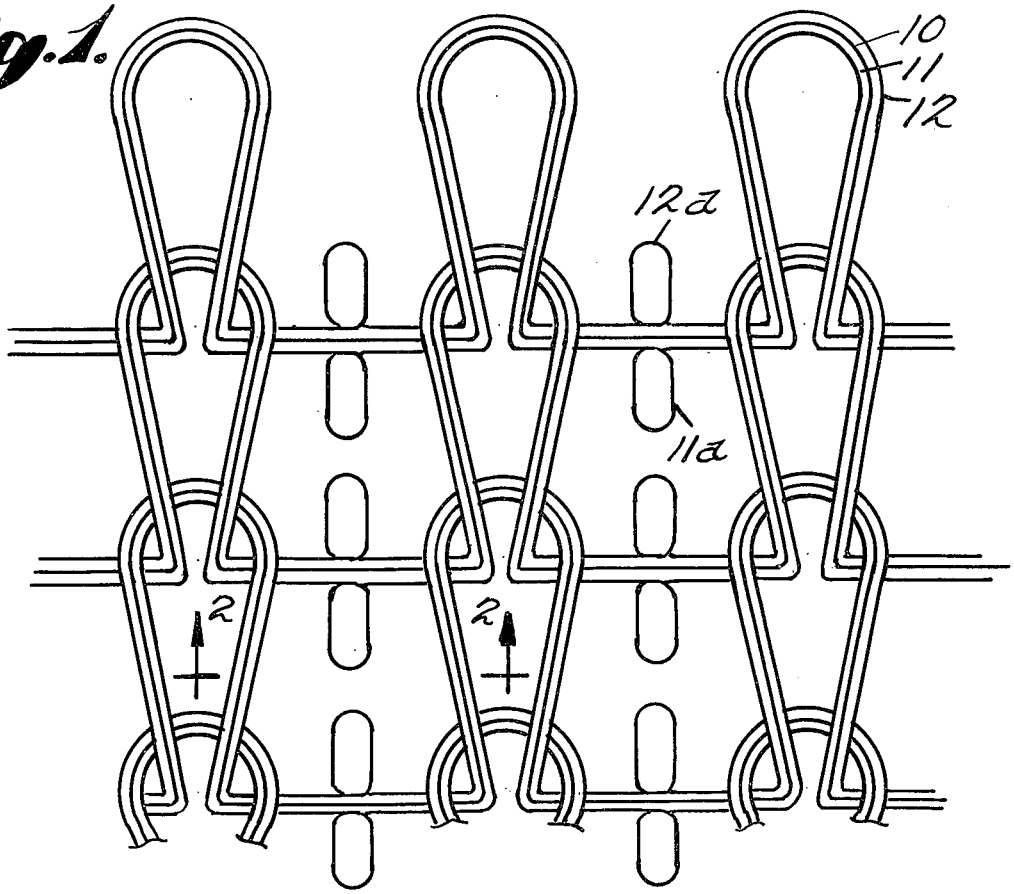
FIG. 1 is a diagrammatic front view of a prior art double terry loop fabric wherein the front loop and back loop yarns are knitted in the base fabric along with a ground yarn.
Figure 2:
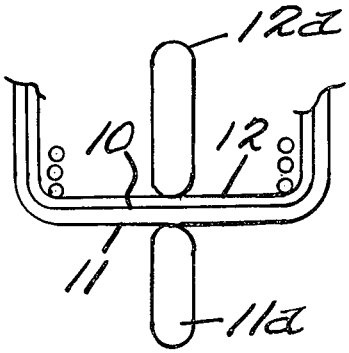
FIG. 2 is a horizontal sectional view of the fabric along the line 2—2 of FIG. 1.

In FIGS. 1 and 2, there is exemplified a prior art form of double terry loop fabric wherein the ground yarn 10, the front loop yarn 11, and the back loop yarn 12 are simultaneously knitted into a base fabric of single jersey construction. The front loop yarn is introduced below the fabric web and on the needle latch through sinker means, as described in Lombardi U.S. Pat. No. 2,893,226 such that long terry loops 11*a* are formed below the fabric and drawn to the technical face side of the fabric. The back loop yarn 12 is introduced on top of a sinker nib in a conventional prior art manner, as for example in Lombardi U.S. Pat. No. 3,477,255, and a terry loop 12*a* is drawn on the technical reverse side of the fabric.

Figure 3:
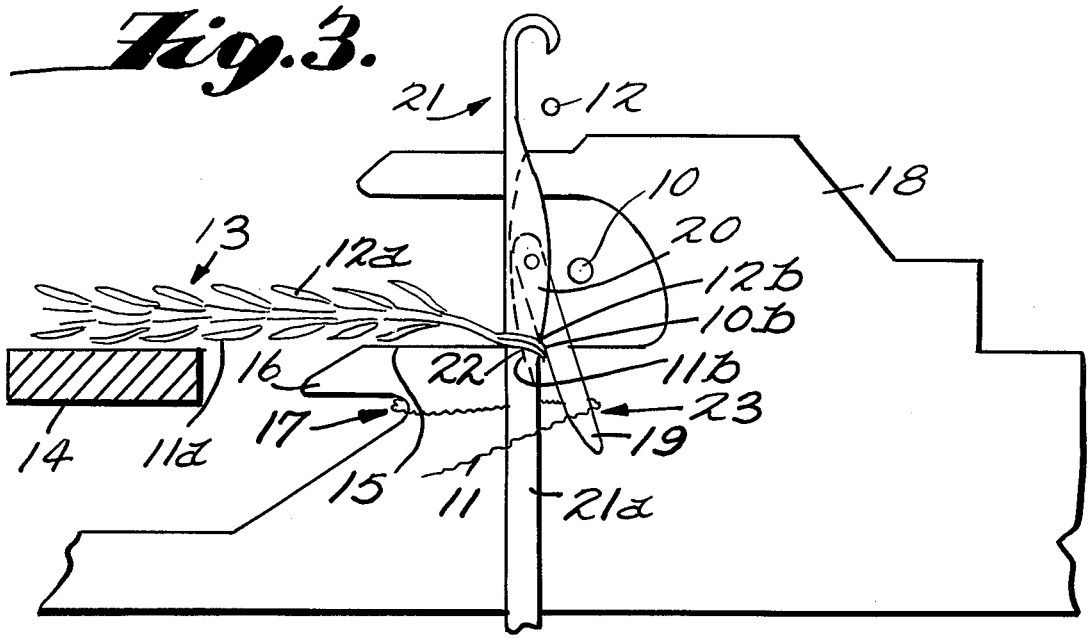
FIG. 3 is a prior art needle/sinker combination wherein the fabric web has been lifted and held tautly on the checks of the needle and below the latch, and wherein a front loop yarn previously introduced into the lower throat of an inwardly advancing sinker starts to exert pressure on the needle latch in the direction of the arrow.
Figure 4:
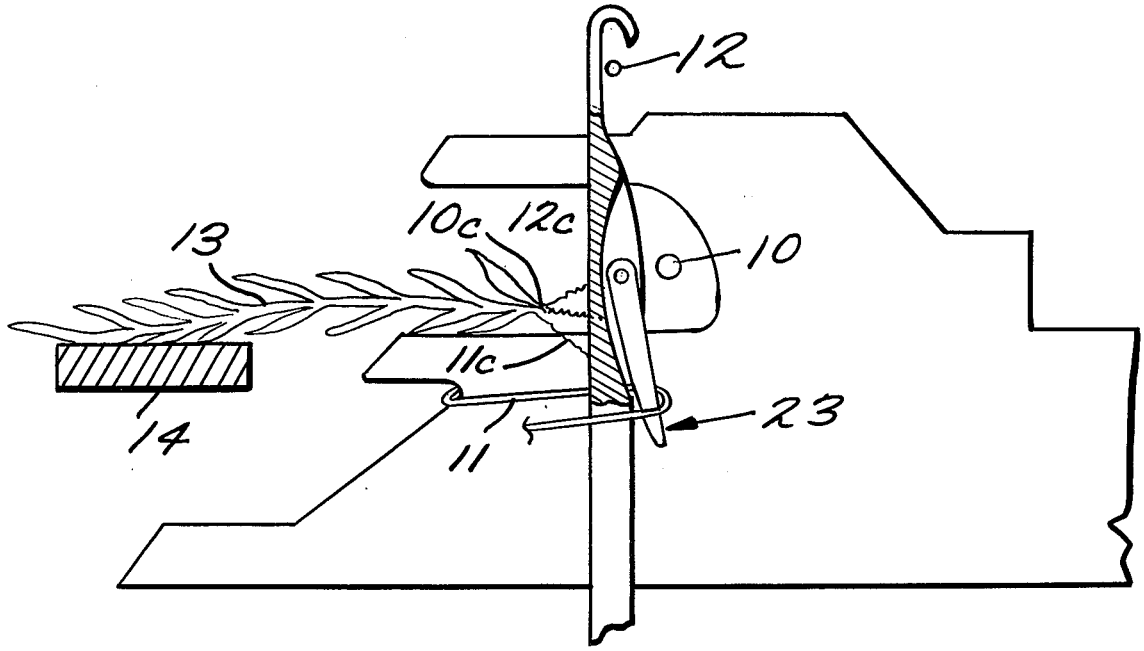
FIG. 4 shows the sinker of FIG. 3 further advanced with still greater pressure exerted on the latch and resultant cutting or scissoring of the ground loops.

In FIGS. 3 and 4, there is illustrated a prior art method as described in Lombardi U.S. Pat. No. 2,893,226 for producing a double terry loop fabric with the front and back loop yarns knitted into the base or ground fabric. In FIG. 3 there is shown a fabric web 13 elevated by fabric lifting means 14 to a level 15 substantially that of the topmost edge of sinker nib 16. It will be noted that front loop yarn 11, previously introduced below the fabric web in the throat 17 of the sinker 18 and on top of the needle latch 19, has been drawn into a front terry loop by the inward movement of the sinker 18. It will be observed that the three ground loops 12*b*, 10*b*, and 11*b* occupy adjacent positions on the needle 21 along the bottom portion of the needle cheek 20. It is to be further noted that grounds loops 12*b*, 10*b*, and 11*b* are restrained from moving down the needle stem 21*a* since the topmost edges 15 of adjacent sinkers (not shown) maintain the entire fabric web at level 15.

Latch 19 is pivotally mounted for relative movement between adjacent cheeks 20 of the needle 21. Therefore, when the previously formed ground loops are tautly held at level 15 of the sinker and below the latch 19, they prevent the latch from opening to its most downwardly extending position to occupy fully the milled portion 22 of the needle 21 as is shown in FIG. 4. Therefore, any lateral pressure in the direction of the arrow 23 such as would be exerted when front terry loop 11 is formed about latch 19 will cause latch 19 to be pulled against the previously formed ground loops. When such a force is created across latch 19, the cheeks 20 and latch 19 together effectuate a scissoring action on the ground loops between the needle cheeks 20 and the juxtaposed needle latch 19. The fact that three ground loops 12*b*, 10*b* and 11*b* may simultaneously occupy adjacent positions on the cheeks of the needle and below the needle latch further aggravates this serious problem.

When the sinker 18 is further advanced as shown in the direction shown by the arrow 23 in FIG. 4, additional pressure exerted by the front loop yarn 11 on the latch 19 creates even greater pressure on the previously formed ground loops thereby shearing them between the needle cheeks 20 and the inner edge of the needle latch 19. The resulting scissored loops are shown at 12*c*, 10*c* and 11*c* in FIG. 4.

Figure 5:
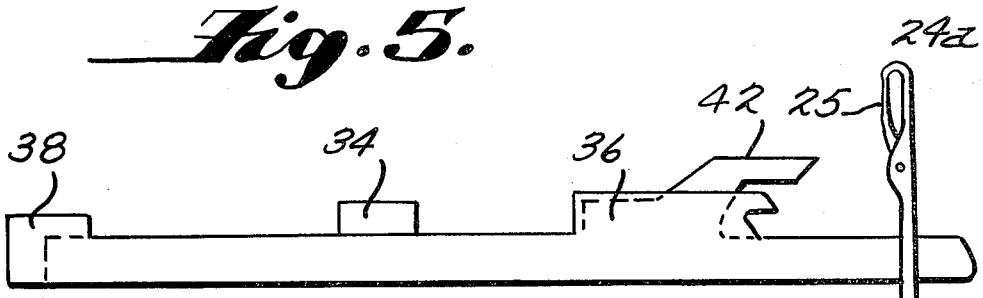
FIG. 5 is a diagrammatic view of one form of the present invention.

FIG. 5 shows one form of the invention for producing double terry loop fabric without the inherent difficulties of earlier prior art approaches. In this embodiment of the invention, there is illustrated needle 24 having a latch 25 and a hook 24*a* mounted with needle jack 26 both being arranged for vertical movement in a slot of a multi-slotted circular knitting machine cylinder (not shown) in a manner well known in the art. Although needle jack 26 and needle 24 are shown as separate elements, it will be understood that a single knitting element can be substituted in the present invention. Vertical movement of jack 26 is imparted by suitable operative means (not shown in FIG. 5) operating on butt 28. Cooperating with needle 24 and slidably mounted thereon for relative movement in the same cylinder slot is latch-arresting jack 30, whose function will hereinafter be described. Cooperating with the needle 24 and latch-arresting jack 30 is a horizontally positioned sinker means 30 mounted for relative movement in a sinker dial (not shown) by suitable operating means well known in the art.

Figures 6, 7A, 7B:
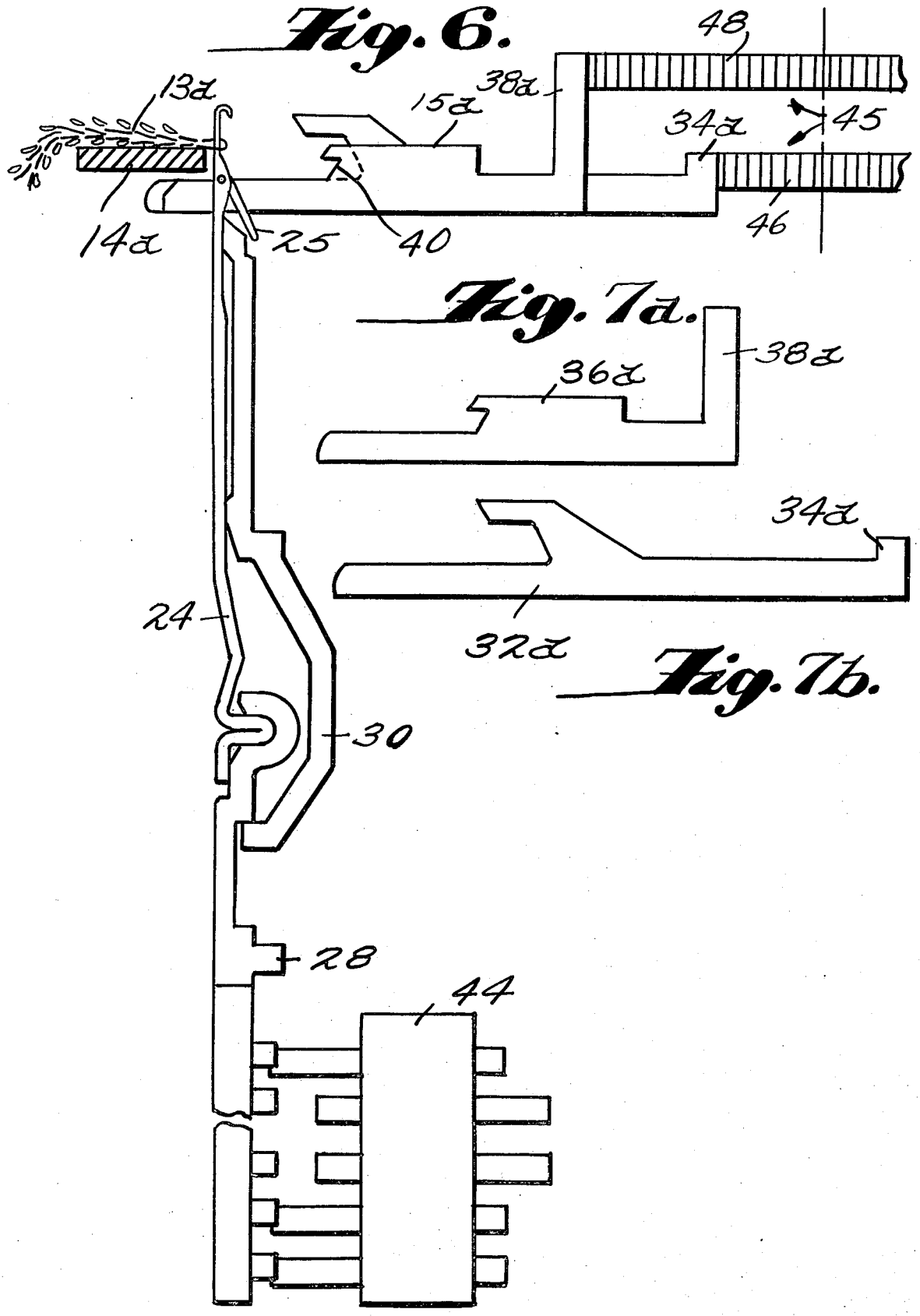
FIG. 6 is a diagrammatic view of another form of the present invention.
FIG. 7*a* is a side view of one form of a front loop forming sinker useful in the practice of the present invention.
FIG. 7*b* is a side view of one form of a back loop forming sinker mounted for relative movement in the same sinker dial slot as the sinker of FIG. 7*a;*
Figure 13:
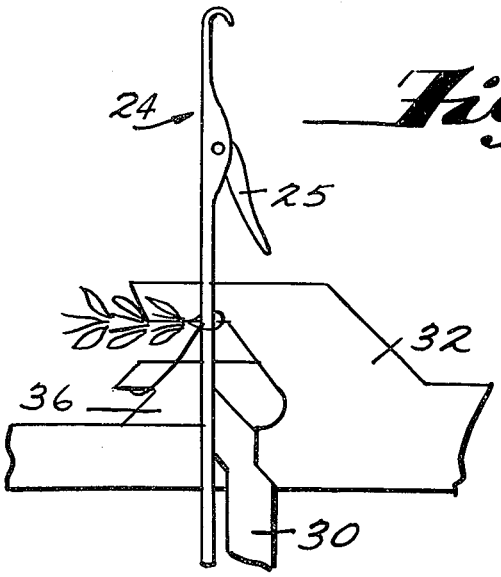
FIG. 13 is a diagrammatic view illustrating a further step in a succeeding feed in the formation of a double terry loop fabric in the practice of the present invention.
Figure 14:
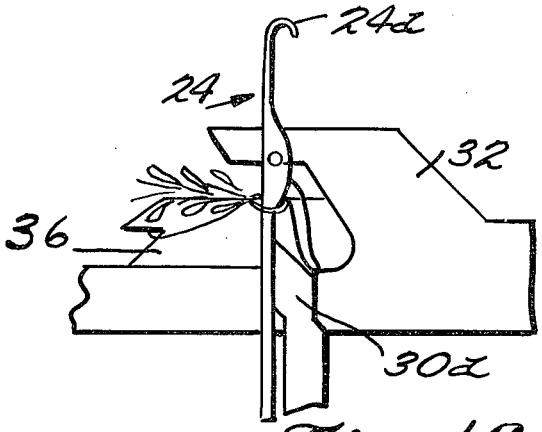
FIG. 14 shows a later step.
Figure 15:
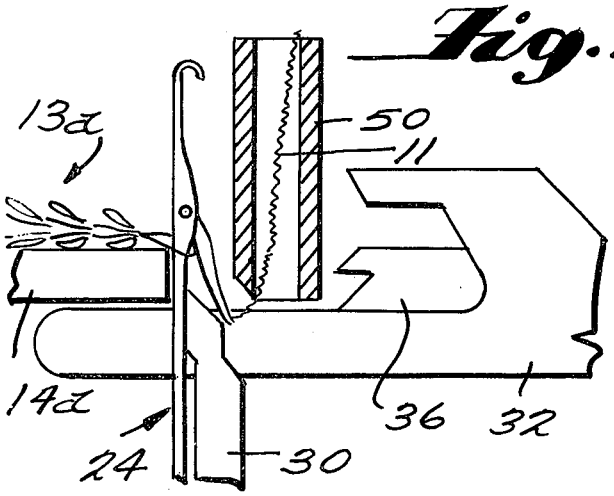
FIG. 15 shows a later step.
Figure 16:
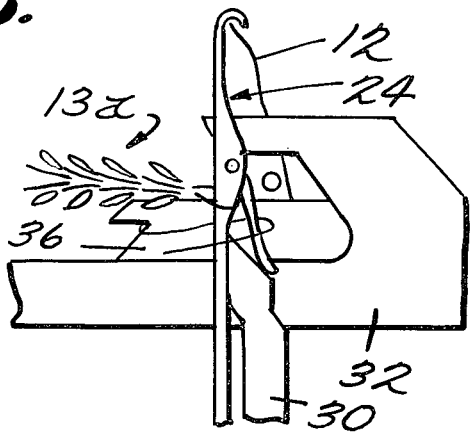
FIG. 16 shows a later step.
Figure 17:
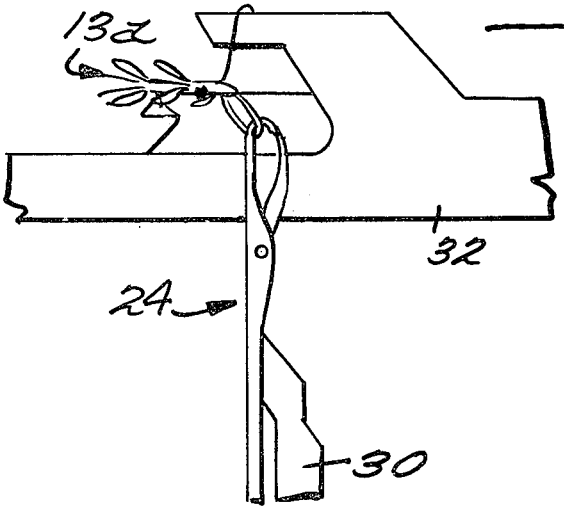
FIG. 17 shows a later step.
Figure 18:
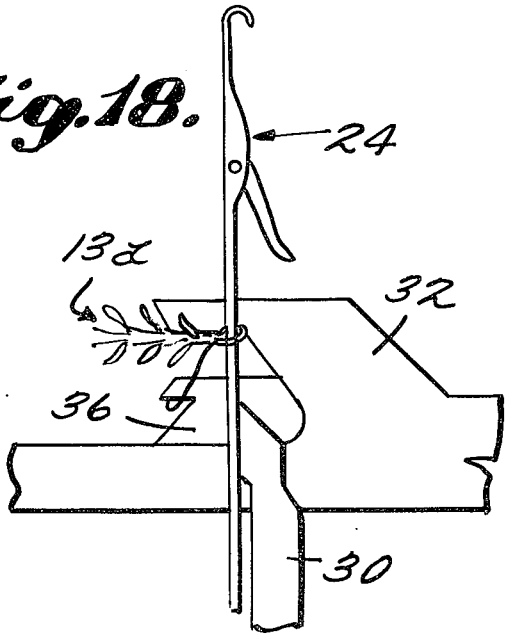
FIG. 18 shows a later step.

Arresting jack 30 is slidably engaged with the needle 24 and needle jack 26. A foot portion 30*b* fits within slot 27 cut into the face of needle jack 26 and during upward and downward movement of needle jack 26, foot portion 30*b* abuts butt-like surfaces 27*a* and 27*b*, respectively, of slot 27. Thus, the arresting jack 30 is out of an arresting position when foot portion 30*b* is in contact with surface 27*a* or immediately adjacent thereto. Alternately, the arresting jack 30 is in arresting position when the upper end 30*a* is adjacent the opened latch 25, as shown in FIG. 6, and foot portion 30*b* is in contact with surface 27*b* or immediately adjacent thereto. The arresting jack 30 may also be moved independently of needle jack 26 by cam means (shown in FIG. 27) which engage the foot portion 30*b*. Thus, arresting jack 30 may be moved at times independently of needle jack 26 while at other times along with needle jack 26. The movement of arresting jack 30 and needle jack 26 is timed such that as needle 24 is being retracted after having been advanced, the arresting jack 30 is held in a raised position (as shown in FIG. 6) and is in its arresting position between needle 24 and latch 25. Thus, when the previously formed ground loops now below the latch 25 are raised on needle 24 by lifting means 14*a*, arresting jack 30 will be in position to prohibit further opening of latch 25. The interaction of these elements will be more fully explained hereinafter. It is only essential, however, that full opening movement of the latch 25 be prevented during the drawing out of the foot loop so that the timing of the positioning of the jack arresting means 30 can be varied.

Figure 5A:
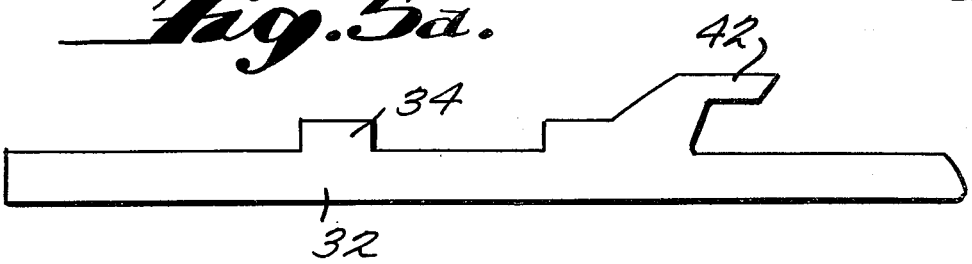
FIG. 5*a* is a side view of the back loop forming sinker shown in FIG. 5.
Figure 5A:
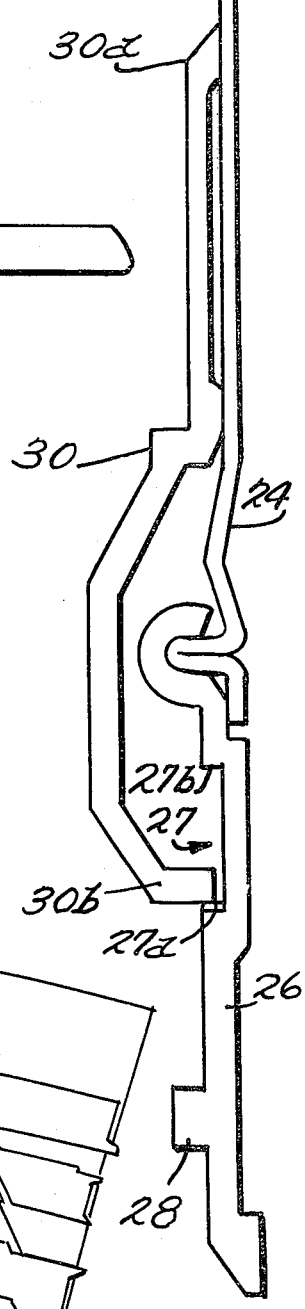

The sinker means 31 is comprised of two separate components sinkers 32 and 36 slidably mounted side by side for relative movement in a single slot of the multi-slotted outwardly extending sinker dial affixed to the cylinder in a manner well known in the art. The two components comprise a back loop forming sinker 32 shown in FIG. 5*a* actuated by cam means (not shown) operating on butt 34 and a front loop forming sinker 36 actuated by separate cam means (not shown) operating on butt 38. Throat 40 of sinker 36 forms the front loop below the fabric web in a manner to be hereinafter described. Sinker ledge 42 of sinker 32 forms the back loop in a conventional prior art manner as described in Lombardi U.S. Pat. No. 3,477,255.

FIG. 6 illustrates the invention employing the needle and jacks shown in FIG. 5. Means are provided for operating the needles, one example being needle selecting means generally indicated at 44. Such needle selecting means are well known in the knitting art and will, accordingly, not be described herein. Another example (not shown in FIG. 6) would be suitable camming means operable on all jack butts 28. In addition, separate operating means are provided generally indicated at 45 for selectively actuating the front loop sinker means and the back loop sinker means. One example of such means are the horizontally mounted pattern wheels as described in Lombardi U.S. Pat. No. 3,477,255 provided for sinker selection. In the present invention, however, an example of such means are the coaxially mounted pattern wheels 46 and 48 operating on the butt ends 34*a* and 38*a* of front loop sinker 36*a* and back loop sinker 32*a*, respectively, represent one method for the selective and independently actuation of these sinker elements. In FIG. 6, pattern wheel means 48 meshing in gear-like fashion with the butt end 38*a* of the front loop-forming sinker 36*a* selectively advances this element to an operating position; and, likewise, pattern wheel means 46 meshing with butt end 34*a*, of back loop-forming sinker 32*a* selectively advances this element to an operating position. As in the case of camming means operative on all jack butts 28, as referred to above, separate camming to operate on all front loop sinker butts 38 and all back loop sinker butts 24 can similarly be employed in the practice of the invention.

As shown in FIG. 6, fabric lifting means 14*a*, positioned at a predetermined location with respect to each feed and mounted inwardly of the needles, supports the fabric web 13*a* at a level sufficiently high so that the web will rest on the ledge 15*a* of front loop sinker 36*a* when such sinker means are radially actuated toward the center of the cylinder. It will also be noted that the latch arresting jack 30 prevents the pivotable latch 25 from swinging to it fully open position.

FIGS. 7*a* and 7*b* show, respectively, one form for a front loop sinker element 36*a* and one form for a back loop sinker element 32*a* provided with butts 34*a* and 38*a*, respectively, which cooperate with selecting means 46 and 48, respectively.

A manner of forming the double terry loop fabric with knitted-in front, back and ground loops as shown in FIG. 1 in the practice of the present invention is illustrated in FIGS. 8 through 18. In FIG. 8 the needle 24 is shown in a fully advanced position with the fabric web 13*a* below the needle latch 25. In FIG. 9, as the needle is actuated downwardly, the front terry loop 11*a* formed in the previous course is still controlled by the front loop sinker means 36. It will be noted that at this point in the knitting sequence the ground loops 10*b*, 11*b* and 12*b* are below the latch 25 and occupy a position well up on the needle cheeks 24*b*. Thus, it is essential to restrain latch 25 from opening too far into cheeks 24*b* below the pivot point, for latch 25. With needle 24 thus retracted, arresting jack 30 is held in its raised position so as to be in operating position. It will be readily observed that the latch arresting jack 30 prevents the latch 25 from fully opening and from opening too far down cheeks 24*b* although up to this point, there is no lateral pressure exerted on the latch.

In the following step as shown in FIG. 10, both the front loop sinker 36 and the back loop sinker 32 are withdrawn, with the fabric web 13*a* now raised and supported by fabric lifting means 14*a*, thus raising the previously formed fabric loops on needle 24 into the space between the tip 30*a* of arresting jack 30 and needle 24. A front loop yarn 11 is guided by yarn carrier means 50 to a level below the fabric web 13*a* but above the latch 25 which is still prevented from fully opening by arresting jack 30. As the front loop sinker 36 is advanced, as shown in FIG. 11, the front loop yarn 11 passes into the sinker throat 40 and is formed into a front terry loop 11*a* by the sinker 36 and the cooperating needles 24 adjacent the sinker. As the front loop sinker 32 is further advanced, the slack 52 in the front terry loop 11*a* is fully taken up and front loop yarn 11 becomes relatively tightly drawn across the sinker throat and the latch 25. This action exerts a lateral pressure on the latch 25 in the direction of arrow 23 forcing the latch against the latch arresting jack 30. However, the arresting jack 30 prevents the latch 25 from fully opening to occupy the milled portion 22 which portion is perhaps best shown in FIG. 3. Consequently, the scissoring action on the ground loops 10*b*, 11*b* and 12*b* is eliminated. Coincident with the formation of the front terry loop 11*a*, a ground yarn 10 is introduced above the latch 25 of the needle 24 and into the throat 41 of the back loop sinker 32 at a level above front loop sinker 36. The back loop sinker 32 is then advanced so that the forward end of sinker nib 54 occupies a position inwardly of the needles as shown in FIG. 11. At this point, a back loop yarn 12 is introduced above the sinker ledge 42 and into the hook 24*a* of the needle 24. When the needle 24 is retracted, as shown in FIG. 12, the ground loops 12*b*, 10*b* and 11*b* previously formed under the latch are raised up on the needle closing the latch. The front, back and body yarns, accordingly are formed simultaneously into new ground loops, and the previous ground loops are cast off into the fabric web 13*a*. In the interest of clarity in the preceding FIGS. 8–12, the ground loops comprising the front, back and body are generally indicated as a single loop below the latch.

The knitting steps depicted in FIGS. 8–12 represent the loop-forming actions occurring at a single yarn feeding station of a multi-feed machine. FIGS. 13–18 illustrate the identical knitting steps at the next yarn feeding station as well as at subsequent yarn feeding stations.

We have determined, however, that by introducing simply a ground yarn at alternate yarn feeding stations with the front, ground and back loop yarns fed at intermediate yarn feeding stations, a fabric with superior front loop height and definition can be readily knitted. With this approach, the knitting steps described in connection with FIGS. 8–12 are initially carried out. However, at the next yarn feeding station when just a ground yarn is introduced, knitting steps depicted in FIGS. 19–24 are employed. With this alternate method, the previously formed front terry loop 11*a* which has already been knitted into the ground fabric is reformed by the front loop sinker as shown in FIG. 19. This front-loop sinker action draws the front terry loop 11*a* taut, thus removing all slackness from the front loop yarn 11 and draws it into a tight ground loop below the needle latch 25. Subsequent to this front loop tightening step, the back loop sinker 32 is retracted and a ground yarn 10 is introduced substantially across the latch 25 of the needle 24 as shown in FIG. 20. In the following steps, back loop sinker 32 is again advanced as shown in FIG. 21. Thereafter, the needle 24 is retracted, with the loop of only ground yarn 10 being pulled through the previously formed front, back and ground loops of the preceding feed, as shown in FIG. 22. In FIG. 23, the needle is again fully advanced with only the ground loop 10*b* of the preceding course passing below the latch 25. In FIG. 24, as the needle 24 and arresting jack 30 are again partially retracted, front loop sinker 36 is again fully advanced thus drawing the front loop 11*a* tightly into ground fabric 13.

Figure 25:
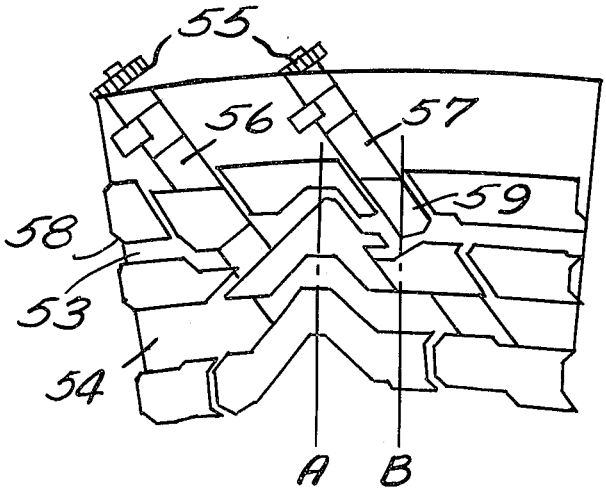
FIG. 25 is a diagrammatic view illustrating the camming means for actuating the two-component sinkers in the steps represented in FIGS. 8 through 18.

FIG. 25 illustrates a dual track cam raceway for independent actuation of the loop-forming sinker means, i.e., front loop sinker 36, and back loop sinker 32. The camming of FIG. 25 represents the movements of cooperating sinkers from one feed to the following feed as depicted in FIGS. 8–12. Raceway 53 defines a cam path in which butt 38 of front loop sinker 36 rides. This raceway controls the radial movement of front loop sinker 36 in a synchronized relationship with the radial movements of back loop sinker 32 whose actuating butt 34 rides in raceway 54. Front loop control is provided by adjusting screws 55 which actuate the cam posts 56 and 57 on which front loop cams 58 and 59 are mounted. Position A in the camming represents the point of maximum retraction of both front and back loop sinker elements as illustrated in FIG. 10. Position B indicates the point of maximum advance of the front loop sinker element as illustrated in FIG. 11.

Figure 26:
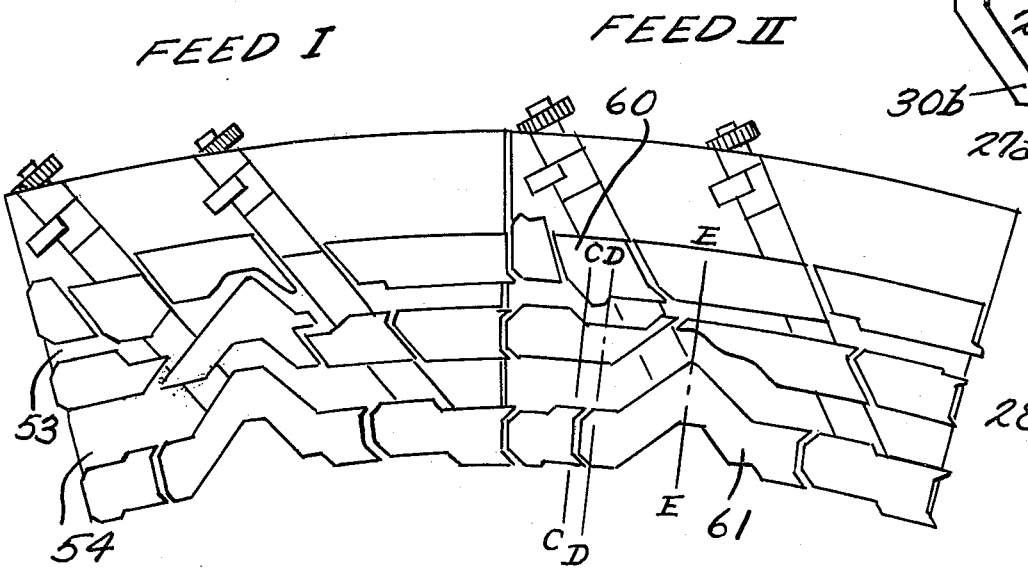
FIG. 26 is a diagrammatic view illustrating alternate camming means for actuating the two-component sinkers in the process representing FIGS. 8 through 12 and FIGS. 19 through 24.

FIG. 26 represents a camming layout for independent two-part sinker actuation used in one form of the present invention. The representation illustrates a two-feed knitting cycle wherein at Feed I, front, ground, and terry back loop yarns are introduced and knitted as illustrated in FIGS. 8 through 12. However, at Feed II, only the ground yarn is introduced, and formed into a knitted ground loop as shown by FIGS. 19–24. At Feed II, camming means are provided to fully advance front loop sinker 36 thus reforming the front terry loop previously knitted at Feed I as described above and in so doing remove the slackness in the front loop yarn by drawing the knitted front terey loop into a tight stitch in the fabric web. As shown in FIG. 26, there are provided cam means 60 for advancing the front loop sinker 36 to a position indicated along line C. It is at this point that the front terry loop 11*a* is reformed with all the slackness of the previously knitted front loop yarn removed. As shown at position D, cam 60 is relieved to permit a degree of confined freedom to the front loop sinker element 36.

Along line E, it will be observed that cam means 61 are provided for retracting the back loop sinker element to its most outermost position. It is at this point that the ground yarn 10 is introduced as shown in FIG. 20 and subsequently drawn into a knitted loop as indicated in FIG. 22.

Figures 26A, 26B:
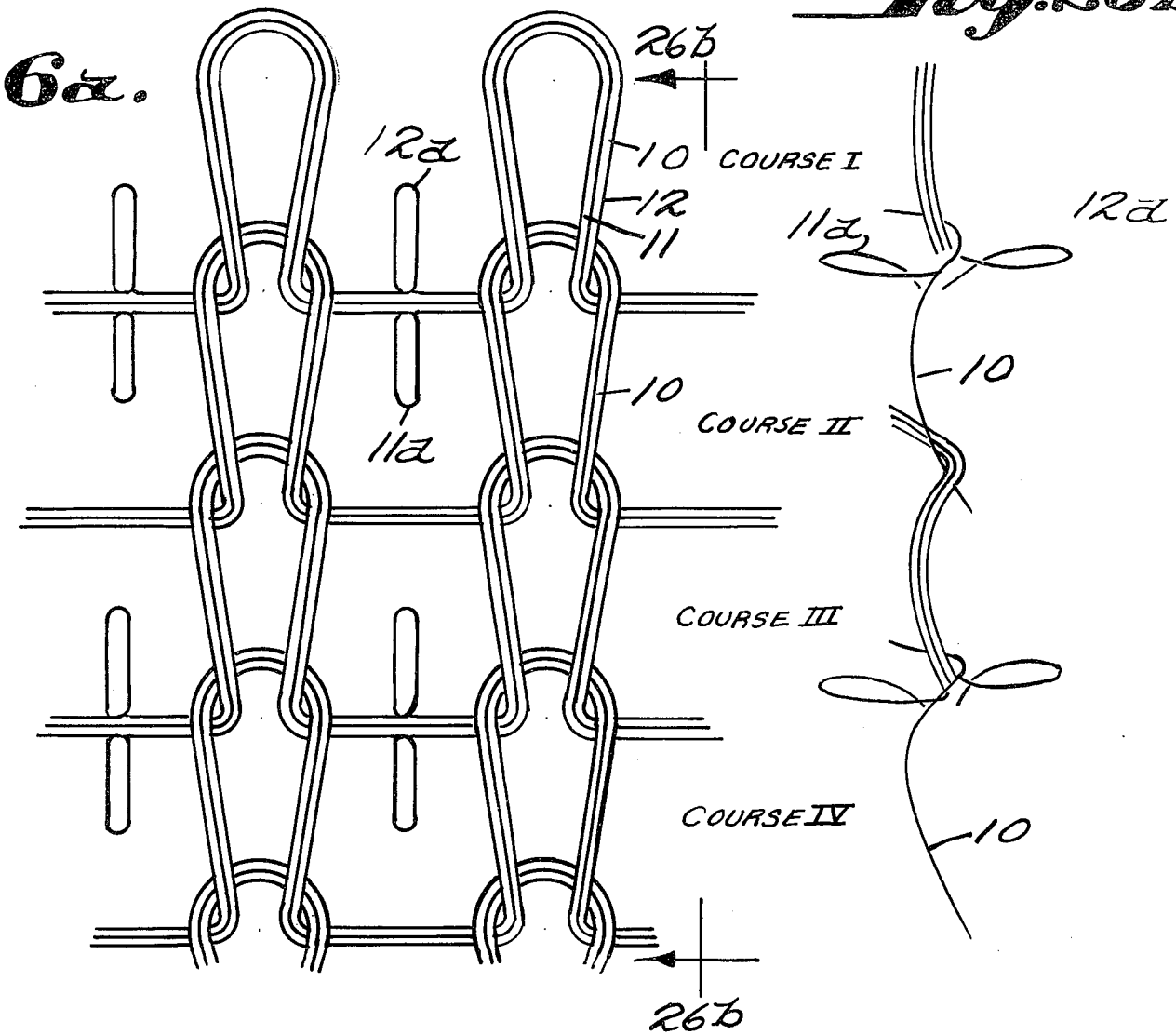
FIG. 26*a* is a diagrammatic front view of a double terry fabric knitted with the camming means of FIG. 26.
FIG. 26*b* is a vertical sectional view taken along the line 26*b*—26*b* of FIG. 26*a;*

FIG. 26*a* illustrates a double terry loop fabric as seen from the face side knitted with the camming of FIG. 26. With this approach as previously described, the front, ground and back loop yarns are introduced as alternate feeds and only the ground yarn is introduced at the intermediate feeds. As shown in FIG. 26*a* and FIG. 26*b*, front loop yarn 11, ground yarn 10, and back loop yarn 12 are introduced in Courses I and III and knitted into the ground fabric with front terry loop 11*a* being drawn to the back of the fabric. In Courses II and IV, only the ground yarn 10 is introduced and knitted into the ground fabric.

Figures 27, 27A, 27B, 27C:
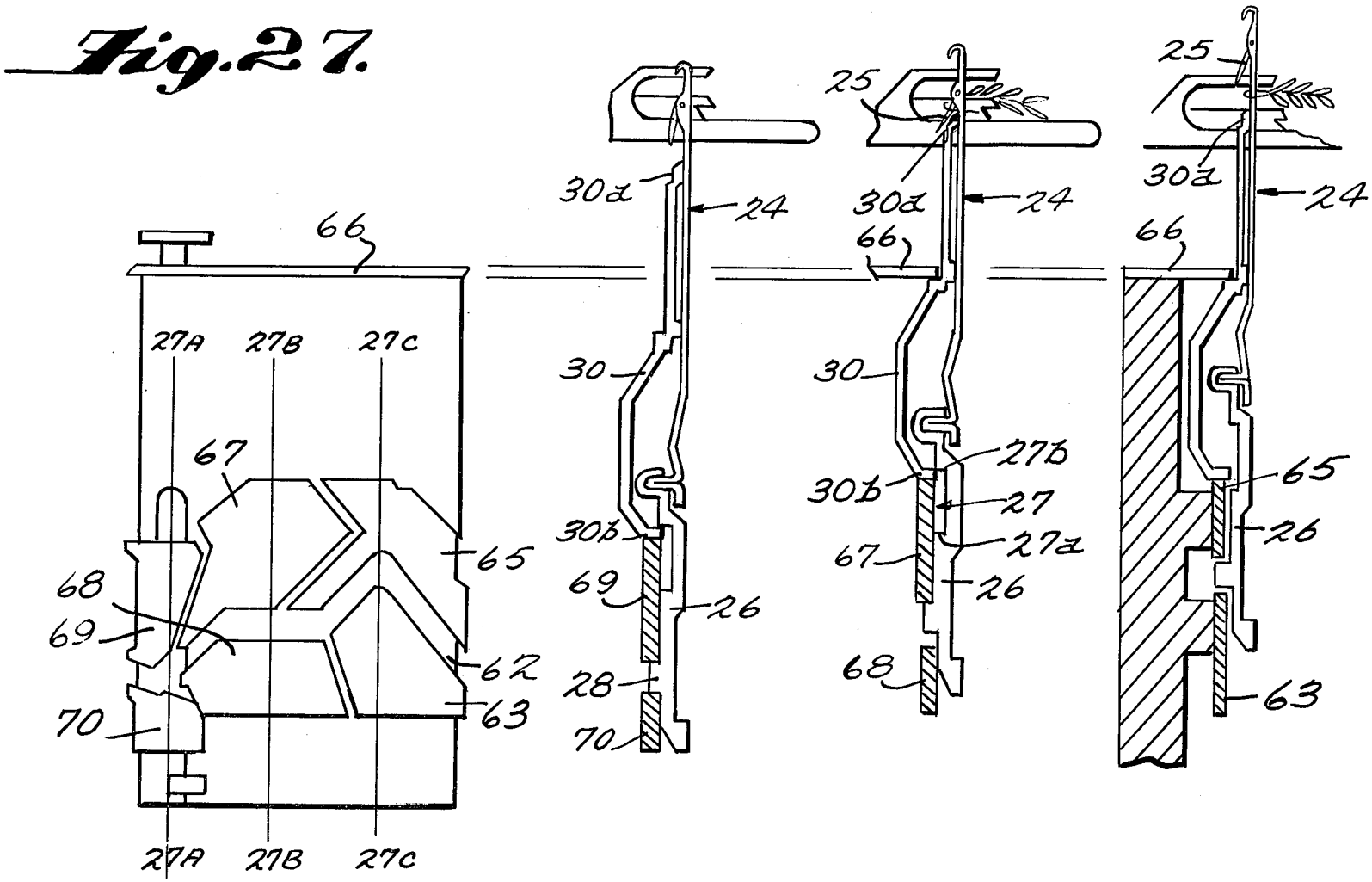
FIG. 27 is a diagrammatic view illustrating the camming means for actuating the needle and its cooperating jack in the formation of double terry loop fabric in the practice of the present invention.
FIG. 27*a* is a view of the needle and jack positions when at line 27*a* — 27*a* of FIG. 27.
FIG. 27*b* is a view of the needle and jack positions when at line 27*b* — 27*b* of FIG. 27.
FIG. 27*c* is a view of the handle and jack positions when at line 27*c* — 27*c* of FIG. 27.

FIG. 27 illustrates the camming means provided for actuating the needle jack 26 with its connected needle 24 and its cooperating latch arresting jack 30. The camming represents the action which takes place at one feed of the machine. It will be noted that butt 28 of the needle jack 24 is made to operate in cam raceway 62 in synchronized relationship with the front and back loop sinker element movements as described in connection with FIG. 25.

There is shown in FIG. 27 cam means 63 for advancing jack member 26 and its associated needle 24 to a position indicated along line 27*c* at which point the needle has been lifted to its maximum height. It will be noted as illustrated in FIG. 27*c* and also FIG. 8 that the ground loops will at this point have passed below the needle latch in anticipation of yarn introduction in subsequent knitting steps. Camming means 65 serve the dual function of cooperating with cam means 63 to define the raceway 62 in which butt 28 of jack member 26 is made to operate. In addition, cam means 65 cooperates with guard cam means 66 to position in a simple but precise manner the location of the upper end 30*a* of latch arresting member 30 in relationship to latch 25. An accurate relationship between these two elements is important since the positioning of arresting jack 30 so as to prevent full opening of latch 25 must occur prior to inward sinker activation in the formation of the front terry loop, thereby providing sufficient clearance under the latch so that the previously formed ground loops will not be subjected to any type of scissoring action as hereinbefore described.

In FIG. 27*b* there is illustrated the position taken along line 27*b* of FIG. 27 of cooperating knitting instrumentalities. This is representative of the elements shown in FIG. 9. As described above in connection with cam 65, cam 67 also serves a dual function. In cooperation with cam 68 it defines the raceway 62 in which butt 28 of jack 26 operates and in addition, in cooperation with cam 66, cam 68 positions precisely the location of latch arresting jack 30 with respect to latch 25 for the purposes described. It will be appreciated that in addition to its function for limiting the vertical movement of latch arresting jack 30, cam 66 serves the further purpose of maintaining the cylinder knitting elements in their respective slots.

Furthermore, in FIG. 27*b* it will be noted that needle jack 26 is provided with a cut-out area 27 whose upper end terminates in a butt-like surface 27*b*. It will be understood that when latch arresting jack 30 is in contact with cam 67, the foot portion 30*b* can be brought flush with surface 27*b*. When in this position, the relationship between tip portion 30*a* and latch 25 is fixed and precisely controlled so as to maintain control over the opening of latch 25.

In FIG. 27*a*, there is shown the knitting action which takes place along the line 27*a* of FIG. 27. This represents the point of maximum draw when ground, front, and back yarns are knitted into the ground fabric.

Figures 28, 29, 30, 31:
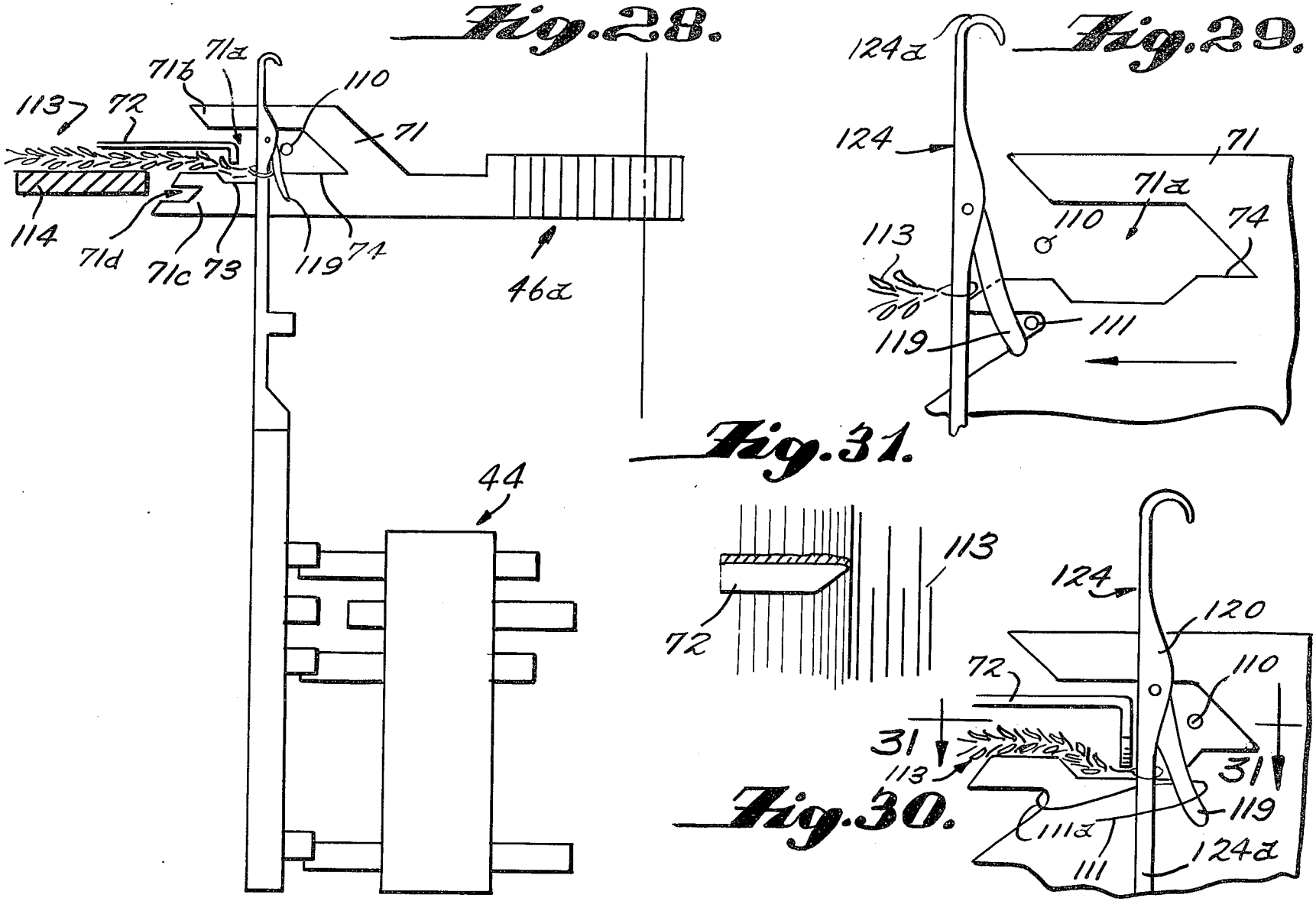
FIG. 28 is a diagrammatic view illustrating an alternate form of the invention incorporating a single component sinker means.
FIG. 29 is a diagrammatic view illustrating an initial step in the formation of double terry loop fabric by the alternate means noted in FIG. 28.
FIG. 30 shows a later step.
FIG. 31 is a front sectional view taken along the line 31 — 31 of FIG. 30.

FIG. 28 represents another embodiment of the invention wherein a single sinker element 71 cooperates with fabric shoe means 72 and needles 124 to form double terry loop fabrics in which front and back loop yarns are knitted along with a ground yarn into a base fabric. Needle operation and selection may be provided by well-known prior art means generally indicated at 44. The single sinker element 71 comprises an upper sinker throat 71*a*, back loop forming portion 71*b* and a front loop forming portion 71*c*. The front loop forming portion further comprises a fabric support level established by lower ledge 74 which has a recessed portion therein at 73 and a front throat 71*d*. In addition, sinker selection may be provided by well known prior art means generally indicated at 46*a*. Fabric lifting means 114, as described earlier, are also provided.

FIGS. 29 through 36 depict the knitting sequence with the special combination of elements shown in FIG. 28. As illustrated in FIG. 29, front loop sinker element 71 is provided with recessed portion 73 on the lower edge 74 at which level the fabric web 113 is supported. It will be noted in FIG. 29 that front loop yarn 111 had previously been introduced below the fabric web 113 and on top of the latch 119. Sinker 71 is partially advanced so that front loop yarn 111 is contacted by sinker 71. Thereafter ground yarn 110 is introduced into the upper throat 71*a* of the sinker 71 as shown in FIG. 29. Sinker 71 is advanced so that the front loop 111a is fully formed and simultaneously a fabric shoe 72 is advanced into the upper sinker throat 71*a* whereby shoe 72 contacts web 113. Fabric shoe 72 is mounted inwardly of the circle of needles 124 for relative circumferential movement with said needles as shown in FIG. 30. The fabric shoe 72 riding against the fabric web 113 in the area of the recessed portion 73 depresses the fabric web 113 as shown in FIGS. 30 and 32 causing web 113 and the previously formed base fabric loops to ride down the needle stem or shank 124*a* away from where scissoring of previously formed loops could occur. It will be observed that as the front terry loop 111a is being fully formed, front loop yarn 111 will exert a lateral pressure in the direction of arrow 23 on latch 119 as previously described. If the fabric web 113 had been maintained at the level of the ledge 74 without the provision for the recessed portion 73 and fabric shoe 72, it would have been held tautly at that level with subsequently shearing or scissoring of the ground loops between the cheeks of the needle 120 and the cooperating latch 119. The recessed portion 73, accordingly, provides space into which the fabric web can be depressed by fabric shoe means 72 to move the previously formed ground loops down the needle stem 124a and away from the point of scissoring.

FIG. 31, a sectional view along line 31—31 of FIG. 30, conveys the manner in which shoe 72 engages the fabric web 113 and depresses it to a non-scissoring level within recessed portion 73.

In FIG. 32, with the fabric shoe 72 still depressing the fabric web down on the stem 124*a* of the needle 124, sinker 71 is partially retracted, thereby creating a certain amount of slack 72 in the front loop yarn 111.

As the needle 124 in FIG. 33 starts its downward motion, sinker 71 continues to slowly retract creating additional slack around latch 119 and a back loop yarn 112 is introduced into the hook 124*a* of the needle 124 at a level above the back loop forming ledge 71*b*. Coincident with this, the previously formed loops below the latch 119 start to pivot latch 119 upwardly. As the latch 119 swings upwardly, the slack 76 previously provided in lower loop yarn 111 is taken up by the upwardly moving latch 119.

In FIG. 34 a later knitting step is depicted, where needle 124 continues to move downwardly and sinker 71 continues to slowly retract creating still more slack in front loop yarn 111 and latch 119 continues to close. However, as shown in FIG. 35, when the needle 124 is retracted and the latch 119 completely closed, the front loop yarn 111, which is retained in the hook 124*a* of the needle 124, has a great deal of slack 76 as developed by the further retraction of the sinker 71 and the robbing-back action of the closing latch 119. At this point, further retraction of sinker 71 is unnecessary as there will no longer be any stress placed on latch 119 or front loop yarn 111 due to the closing of latch 119. Therefore, sinker 71 is again advanced to take up the created slack material 76 previously created and to initiate the reforming of front loop 111*a*. The back loop 112*a* is partially drawn at this point.

As shown in FIG. 36, the needle continues its downward motion to fully form the back terry loop 112*a*. Coincident with this, the sinker 71 continues to advance to draw and reform the front loop 111*a* tightly about sinker 71 and needle 124. When the needle 124 is fully retractd the previously formed ground loops are knocked over into the fabric 113.

FIGS. 37 through 42 depict an alternate single sinker approach wherein the fabric shoe means 72 described in the preceding sequence is not used.

Figure 37:
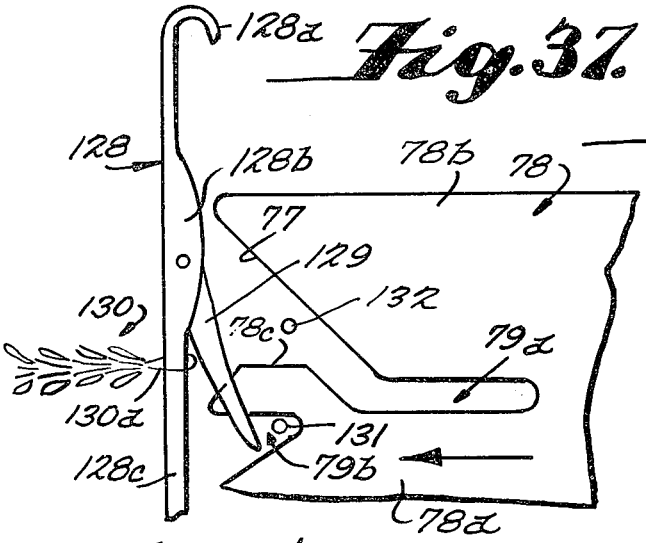
FIG. 37 is a diagrammatic view illustrating one step in the formation of double terry loop fabric using an alternate form of a single component sinker means in the practice of the present invention.

As shown in FIG. 37, sinker 78 is of one piece construction and is comprised of a front loop forming portion 78*a* and an upper portion 78b with upper portion 78*b* being spaced from portion 78a thereby defining sinker throat 79*a* therebetween.

The front loop forming portion 78*a* is formed with a front throat 79*b* and a raised fabric level support surface 78*c*. As is indicated, sinker throat 79*a* is recessed from the raised fabric support surface 78*c*.

The upper portion 78*b* of sinker 78 is provided with leading edge 77 which slopes downwardly toward sinker throat 79*a*. The needles 128 have been moved to their yarn receiving positions, as shown in FIG. 37, and a front loop yarn 131 and a ground yarn 132 have been fed, the front loop yarn being fed across latch 129 while ground 132 was fed substantially at a level corresponding to the level where latch 129 is attached to needle 128. As sinker 78 is advanced, front loop yarn 111 enters front loop throat 79*b* and edge 77 contacts ground yarn 132 and subsequently base fabric 130 and forces ground yarn 132 and fabric 113 downwardly into sinker throat 79*a*.

Figure 38:
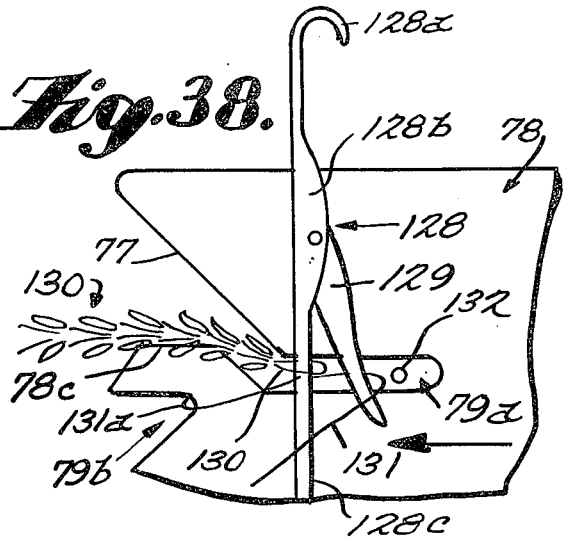
FIG. 38 shows a later step.

As shown in FIG. 38, the advancing sinker 78 engages the fabric web 130 along the downwardly extending leading edge 77 of sinker 78, and depresses the web 130 into the throat 79*a* of sinker 78. Movement of the fabric web 130 down edge 77 thereby causes the previously formed fabric loops 130a to move down the needle stem 128*c* away from the point where scissoring between the needle cheeks 128*b* and cooperating latch 129 can occur. As sinker 78 is further advanced, front loop yarn 131 is kinked around the needle latch 129 and cooperating sinkers 78.

Figure 39:
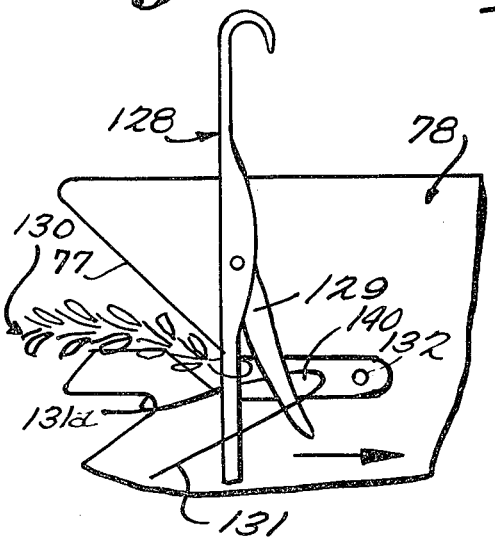
FIG. 39 shows a later step.

Preparatory to the retraction of needle 128, as shown in FIG. 39, sinker 78 is slowly retracted in the direction of the arrow so that a certain amount of slack 140 is formed in front loop yarn 131 around latch 129.

Figure 40:
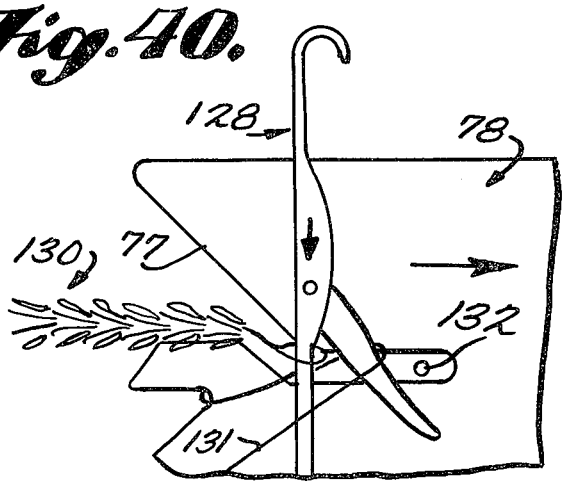
FIG. 40 shows a later step.

Turning now to FIG. 40, the retraction of needle 128 has been initiated and sinker 78 continues to be slowly retracted, thereby creating additional slack in front loop yarn 131. The slack is provided so that as needle 128 is lowered, the previously formed ground loops on the stem of needle 128 move upwards thereby allowing the closing of latch 129 to be readily effectuated. The amount of slack in front loop yarn 131 provided by the slow retraction of sinker 78 insures a sufficient yarn surplus so that stress is not placed on either latch 129 or front loop yarn 132, thereby preventing damage to latch 129 and the severing or fraying of the front loop yarn 132.

Figure 41:
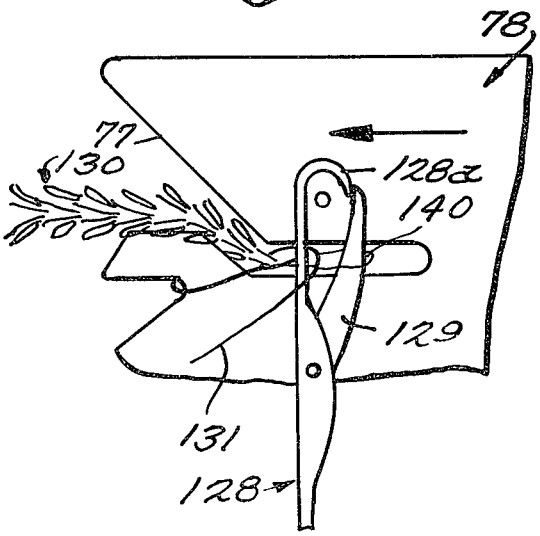
FIG. 41 shows a later step.
Figure 42:
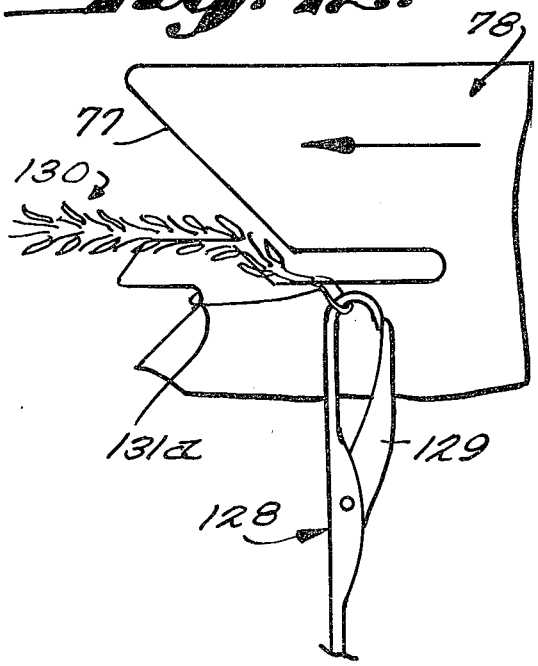
FIG. 42 shows a later step.

As shown in FIG. 41, the needle 128 has been retracted sufficiently so that latch 129 is not completely closed and the front loop yarn 131 along with the ground yarn 131 are now within the hook 128*a* of needle 128. As discussed above, with regard to FIG. 35, there is a great deal of slack in front loop yarn 131 and for this reason, further retraction of sinker 78 is no longer required. Thus, sinker 78 is advanced so as to take up the slack created as at 140 and to initiate the reforming of front loop 132a, as shown in FIG. 42. FIG. 42 shows that needle 128 continues to be moved downwardly so as to complete the formation of the front loop and the previously formed ground loops are knocked over into fabric 130.

Although a back loop yarn is not introduced in the FIGS. 37 through 42 sequence, all other knitting steps as previously described are performed. It will be understood, that if desired, a back loop yarn could have been introduced as in earlier representations.

Figure 43:
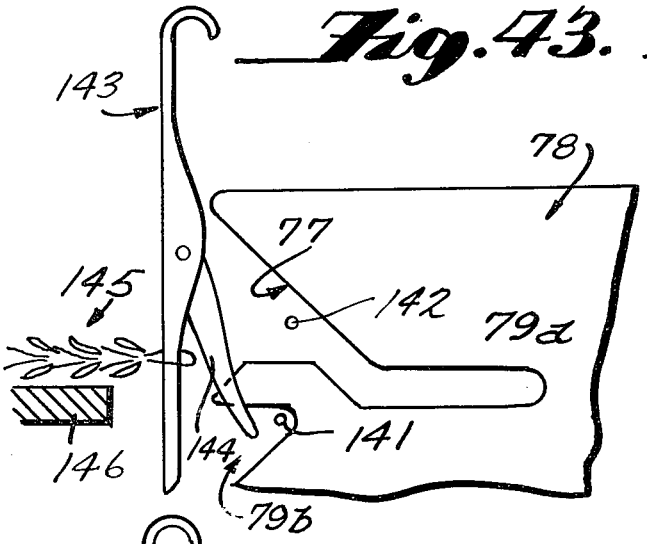
FIG. 43 illustrates an alternate step in the actuation of odd knitting needles at odd yarn feeding stations in the formation of double terry loop fabric according to the present invention.
Figure 44:
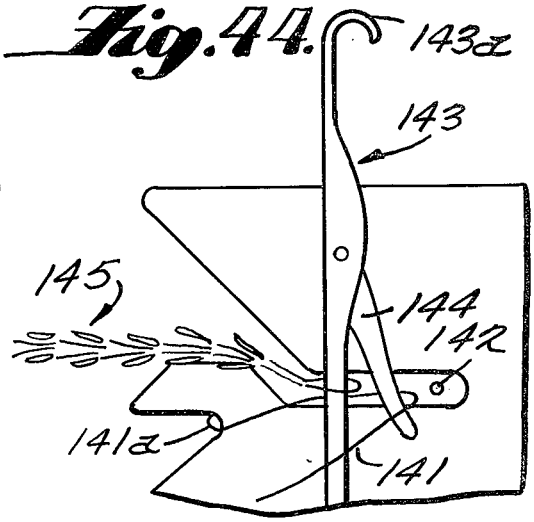
FIG. 44 shows a later step in the actuation of the odd knitting needles.
Figure 45:
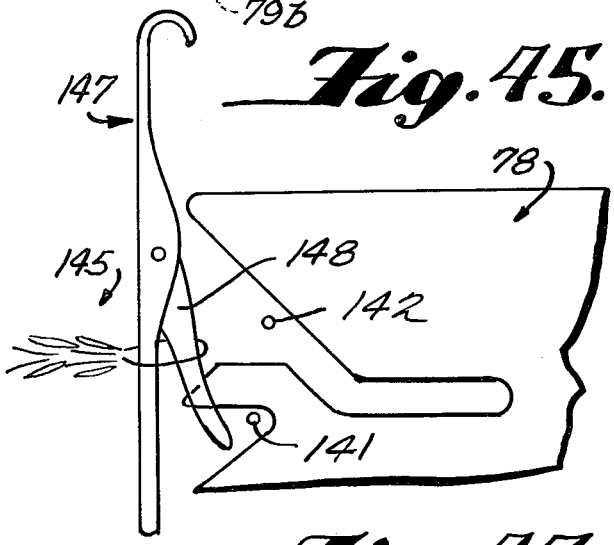
FIG. 45 illustrates the actuation of the even knitting needles at odd yarn feeding stations according to the present invention.
Figure 46:
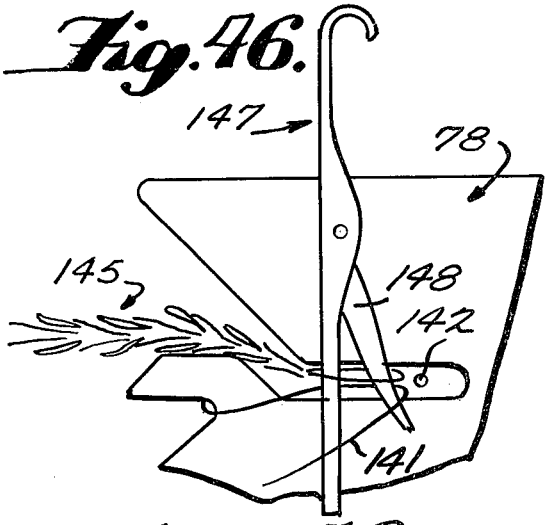
FIG. 46 shows a later step in the actuation of the even knitting needles.

FIGS. 43 through 46 illustrate the use of sinker 78 previously described wherein at an odd yarn feeding position the knitting of odd needles along with the tucking with even needles is carried out. More specifically, FIGS. 43 and 44 depict two steps in the knitting of odd needles 143 at an odd feed and FIGS. 45 and 46 show two knitting steps at the same odd feeding station wherein the even needles 147 are tucked.

With reference to FIG. 43, the needle is in its raised position and previously formed fabric loops from fabric 145 are on the needle below latch 144. Front loop yarn 141 is fed across latch 144 and into throat **79*b* of sinker 78 while ground yarn 142 is fed along surface 77 of sinker 78. As the sinker is moved toward odd needle 143, front loop yarn 141 is kinked around latch 144 and ground yarn 142 is moved downwardly along surface 77 into throat 79a. As shown in FIG. 44, odd needle 143 is in position to be retracted so that when the previously formed loops comprising fabric 145 are raised, latch 144 will be closed such that front loop yarn 141 and ground yarn 142 will be held within the closed hook 143a of odd needle 143. Upon a full retraction of needle 143, knitted ground loops will be formed with front yarn 141 and ground yarn 142**.

With regard to FIG. 45, the previously formed ground loops of fabric 145 are now positioned about latch 148 of even needle 147. Front loop forming yarn 141 is fed into throat **79*b* of sinker 78 while ground yarn 142 is fed along surface 77 of sinker 78. As sinker 78 is advanced toward even needle 147 front loop yarn 141 is kinked about latch 148 and ground yarn 142 is moved downwardly along surface 77 into throat 79*a* of sinker 78. As shown in FIG. 46, even needle 147 is in position to be retracted and upon retraction, the previously formed loops comprising fabric 145, i.e., front loop yarn 141 and ground yarn 142, will remain within the closed hook of even needle 147 and will not be cast off the even needle 147** until the knitting action at the following feed is completed.

The sequence described above is reversed at the even feeds, such that the odd needles which were previously knitting will now tuck while the even needles, previously tucking will now knit. Knitting terry loop fabric in the manner described makes for a more random distribution of terry loops in the final fabric.

Figure 47:
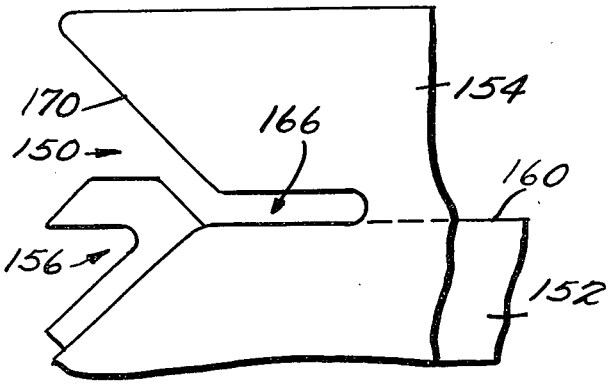
FIG. 47 illustrates a combination of front and back loop-forming elements.

FIG. 47 shows a two-part sinker generally indicated at 150 comprised of a front loop-forming member 152 and a back loop-forming member 154. The two-part sinker 150 is designed to accomplish results similar to sinker 78 but because it is constructed of two individual loop-forming portions, increased control in forming front and back terry loops as well as additional styling possibilities are more readily achieved.

Figure 48:
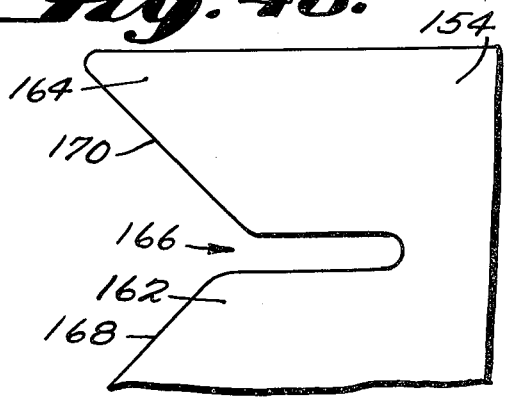
FIG. 48 illustrates a side view of the back-loop forming element of a two-component sinker alternately used in FIGS. 37 through 42.

As shown in FIG. 48, the back loop-forming portion 154 is formed having two front portions, a lower portion 162 and an upper portion 164 with portions 162 and 164 being spaced from each other thereby defining a throat 166 therebetween. Each of the portions 162 and 164 have leading edges 168 and 170, respectively, which are sloped toward throat 166 with leading edge 170 thereby forming a camming surface.

Figure 49:
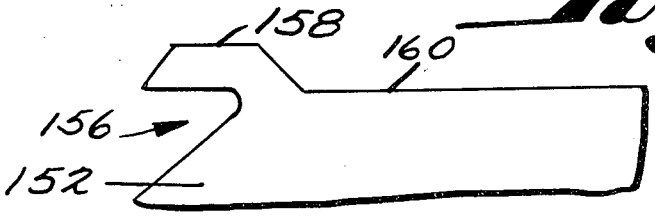
FIG. 49 illustrates a side view of a front loop-forming element of a two-component sinker alternately used in FIGS. 37 through 42.

As shown in FIG. 49, the front loop-forming portion 152 is formed with a front throat 156 into which a front loop yarn will be fed, a raised fabric support surface 158 and a recessed upper edge 160.

FIG. 50 illustrates another embodiment of the invention wherein front loops **191*a* are formed with front loop sinker means 196 mounted in sinker dial members (not shown) located outwardly of the circle of needles 194 and wherein back loops 192*a* are formed with back loop dial jack means 180, mounted in a dial member 181 located inwardly of the circle of needles 194. In the present embodiment, the sinker means 196 are provided with a projection 198 formed at the forward end of the sinker and extending upwardly to a position substantially at the level of the sinker ledge 200. The function of the projection 198 is to provide lifting means for elevating the fabric web 193 so that when the sinker means 196 are advanced, the fabric web 193 will rest on ledge 200**.

Since the operation of the needles 194, the arresting member 202, the needle operating and pattern selection means 204 and sinker operating and selection means 206 have been discussed previously, further explanation of these elements is omitted.

For producing back loops, there is provided an inner dial member 181 incorporating radial slots 182 for receiving dial jacks 180. The dial jacks 180 may be operated by suitable means generally indicated at 183 which for example may be horizontally mounted pattern wheel means 185 operating off the butts 184 of dial jacks 180 to urge certain of the dial jacks 180 toward needles 194 so that the forward ends of the actuated dial jacks 180 are moved across the needle circle, as shown. In the formation of double terry fabric with the present embodiment of FIG. 50, the front terry loop yarn 191 is introduced and formed as in the previous embodiments. The back loop yarn 192 is introduced into the hook **194*a* of the needle 194 above the actuated dial jack 180. As needle 194 is retracted, a ground yarn 190 is also introduced into the needle hook 194*a* but at a level elow the dial jacks 180, as shown. Consequently, as the needle 194 is fully withdrawn, the back loop yarn 192, the front loop yarn 191, and the ground yarn 190 are simultaneously knitted into the ground structure and the previously formed loops are knocked over into the fabric 193**.

FIG. 51 represents a modification of the embodiment shown in FIG. 50 in that the dial jack 208 is formed at its forward end 210 with high and low loop forming ledges 212 and 214 respectively, for creating terry fabrics 216 in which the back terry loops 222 may be produced on a selectively high-low-or no loop basis. FIG. 52 illustrates one form of fabric 216 producible with the apparatus shown in FIG. 51 wherein front loops 221 are of uniform length and back loops **222*a* and 222*b* are of different height. A ground loop is indicated at 220**.

In FIG. 53 there is shown one form of needle designed to eliminate the scissoring action described earlier. The needle 224 is slotted as at 226 to receive latch 219 pivotably mounted by rivet means 228. The milled slot 226 terminates at a bottom location 230 to provide a high latch stand 232. The pivoting end of the latch 219 is formed with an extended surface 240 which acts as a stop and which is shaped so as to rest firmly on the bottom of milled slot 226. When surface 240 comes to rest against the bottom of milled slot 226, the latch 219 cannot be opened further beyond this seated position. Consequently, despite lateral pressure in the direction of arrow 243 exerted during the formation of the front terry loop 245, the latch cannot pivot further toward the needle stem 224*a*, so that scissoring of ground loops generally indicated at 247 between the bottomside of the latch and the cheeks 226 of the needle is prevented. To provide further assurance in this regard, there is provided along the bottom surface of latch 219 a recessed portion 250 which provides additional clearance between the bottom of the latch and the stem of the needle as shown.

FIG. 54 shows an alternate form of a needle which is likewise designed to eliminate the above described scissoring action. The needle 270 is also slotted as at 272 and latch 274 is pivotally attached by a rivet 276. The stem 278 of needle 274 is formed with an off-set projection 280. This off-set projection 280 is positioned a sufficient distance below rivet 276 such that when latch 274 pivots downwardly to its open position, as shown in FIG. 54, the latch 274 will come into contact with projection 280 and further pivoting in a downward direction is prevented. Further, when latch 274 is in contact with projection 280 a space 282 is created between the stem of needle 270 and latch 274 in which the previously formed loops 290, as shown in FIG. 55, will be retained. It can be noted that the stem of needle 274 is not simply provided with a projection but rather that the stem is off-set to create projection 280. Therefore, the cross-section of the stem along the projection 280 and on both sides thereof is uniform. Thus, when the previously formed fabric loops 290 are moved across the projection 280 the fabric may be extended or stretched but the previously formed fabric loops themselves will not be enlarged since the cross-section of the needle stem does not vary.

FIG. 55 illustrates the combination of the off-set needle 270 as shown in FIG. 54 with a one-piece sinker element 292 which together can form the terry cloth fabric 294.

FIG. 56 is a further embodiment wherein the latch arresting jack 260 is further provided with an outwardly extending projection 262 around which the front loop 264 is formed. This approach removes all lateral pressure from the latch 266 during the front loops forming operation. In addition, this arresting jack can be used with any of the sinkers disclosed and shown herein.

Having described the preferred embodiment of the present invention, it can be appreciated that there may be many additional combinations which will overcome the problems enumerated hereinbefore. Therefore, it is contemplated that many variations can be made in the present invention as described above. These and other variations and applications will become obvious to those skilled in the knitting art and all such variations and uses are intended to be included within the scope of the claims.

What is claimed is:

1. An improved knitting mechanism for forming terry cloth fabric in which at least the technical front face of a knitted ground fabric is provided with upstanding front loops knit therein comprising:

a plurality of needles having latches pivotally attached thereto which move between open and closed positions;

sinker means for cooperating with said plurality of needles for forming knitted in loops on at least the technical front face of said base fabric;

means to feed a ground yarn and at least front loop yarn;

means for lifting the fabric to a level to allow a front loop yarn to be fed beneath the fabric;

means for arresting the pivotal movement of the latches thereby controlling the extent to which the latches can open so as to prevent the severing of loops forming said fabric while such loops are held on said plurality of needles below the latches; and means for operating said needles and said sinker means.

2. An improved knitting mechanism for forming terry cloth fabric in which at least the technical front face of a knitted ground fabric is provided with upstanding front loops knit therein comprising:

a plurality of needles having latches pivotally attached thereto which move between open and closed positions;

jack means for operating said plurality of needles;

sinker means for cooperating with said plurality of needles for forming knitted-in loops on at least the technical front face of said fabric;

means to feed a ground yarn and at least front loop yarn;

means for lifting the fabric to a level to allow front loop yarn to be fed beneath the fabric;

means for arresting the pivotal movement of the latches thereby controlling the extent to which the latches can open so as to prevent the severing of loops forming said fabric while such loops are held on said plurality of needles below the latches; and means for operating said needles and said sinker means.

3. An improved knitting mechanism as claimed in claim 2 wherein each of said plurality of needles has a bottom butt portion adapted to fit with said jack means, and a top portion formed into a hook, wherein said latch arresting means comprises an arresting jack for each of said plurality of needles, each said arresting jack being adapted to fit adjacent one of said plurality of needles so as to be movable between a raised operative and a normal inoperative position, said arresting jack having an upper end adapted to fit between the stem of said one of said plurality of needles and the latch thereon when said arresting jack is in said raised operative position so as to prevent further latch pivoting.

4. An improved knitting mechanism as claimed in claim 3 wherein the upper end of said arresting jack is provided with an upstanding projection located outwardly from said upward end thereby defining a space between said projection and said upper end, said projection being positioned so that yarns being fed to one of said plurality of needles will be received about said projection rather than about said needle latch.

5. An improved mechanism as claimed in claim 3 wherein said jack means comprises a jack for each of said plurality of needles, each jack having a stem which has top and bottom portions, the top end being adapted to engage the bottom of one of said plurality of needles, said stem being provided with a slot located below the top portion of said stem, said slot terminating at upper and lower butt-like surfaces and wherein said arresting jack further comprises a foot portion adapted to slidably engage said slot in said jack such that the foot portion substantially engages the lower butt-like surface when said arresting jack is in its normal position and substantially engages the upper butt-like surface when said arresting jack is in its raised position.

6. An improved knitting mechanism as claimed in claim 5 wherein said sinker means comprises a plurality of sinkers each comprised of a front loop-forming element being positioned adjacent a back loop-forming element, each of said front loop-forming elements and said back loop-forming elements being adapted for movement independently of one another.

7. An improved knitting mechanism as claimed in claim 6 wherein means for operating said sinker means further comprises means for selectively actuating each said front loop-forming element and each said back loop-forming element.

8. An improved knitting mechanism as claimed in claim 7 wherein said front loop forming element and said back loop forming element are each provided with a butt projection, and wherein said selectively activating means further comprises a pattern wheel for each of said first and second loop forming elements adapted to contact said butt projections on said first and second sinker elements thereby providing independent selection for each of said first and second sinker elements.

9. An improved knitting mechanism as claimed in claim 2 wherein said means for operating said jack means further comprises pattern selecting means for determining the actuation pattern of said plurality of needles; and wherein said sinker means comprises a plurality of sinker elements, and said means for operating said sinker means further comprises pattern selection means for selectively actuating said sinker elements.

10. An improved knitting mechanism as claimed in claim 5 wherein said means for operating said jack means further comprises pattern selecting means for determining the actuation pattern of said plurality of needles; and wherein said sinker means comprises a plurality of sinker elements, and said means for operating said sinker means further comprises pattern selection means for selectively actuating said sinker elements.

11. A knitting mechanism as claimed in claim 1 wherein said latch arresting means comprises an off-set projection formed within the stem of the needles in the same direction as the hook and spaced a distance below the point where the latch is attached to the stem such that when the latch pivots to an open position the latch will engage the projections so that pivoting of the latch beyond that position is prevented.

12. An improved knitting mechanism as claimed in claim 1 wherein the latch is retained within a milled slot within the needle, said slot having an arcuate rear surface, said latch arresting means comprises an extended bearing surface formed on the pivoting end of the latch, said extended bearing surface being adapted to come into contact with said arcuate rear surface so as to prohibit further pivoting of the latch.

13. A knitting machine comprising a row of latch needles, a row of sinkers having yarn-receiving throats on a plurality of levels, means to feed yarn on one of said levels, means to feed yarn on a lower of said levels, coordinated sinker-operating means and needle-operating means for actuating said sinkers to receive yarn in the throat on the level on which it is fed and to draw out the lower yarn to the front of a fabric being formed, and for manipulating said sinkers and needles to knit the yarns into a fabric, and means to support a fabric at a level above said lower level at least during the feeding and reception of yarn fed at said lower of said levels wherein the improvement comprises means for arresting the pivotal movement of the latches thereby controlling the extent to which the latches can open so as to prevent the severing of loops forming said fabric while such loops are held on said needles below the latches.

14. A knitting mechanism for forming terry cloth fabric provided with upstanding loops knitted in the technical front face comprising: a row of latch needles, a row of sinkers having upper and lower yarn-receiving throats, means to feed front terry yarn at a given level for reception by said lower throat, means to feed body yarn at a higher level for reception by said upper throat and means to support fabric above said given level at least when the first-mentioned yarn-feeding means is operative, and, means for arresting the pivotal movement of the latches thereby controlling the extent to which the latches can open so as to prevent the severing of loops forming said fabric while such loops are held on said needles below the latches.

15. An improved knitting mechanism for forming a terry cloth fabric having knitted-in loops in at least the front face comprising a plurality of needles having latches pivotally attached thereto which move between open and closed positions; means for feeding ground yarns and at least a front loop yarn; fabric lifting means for lifting the fabric sufficiently high so that the front loop yarn can be fed beneath the fabric; loop-forming means for forming terry loops on at least the front face of said fabric; latch arresting means for arresting the pivotal movement of said latches so as to prevent severing of previously formed fabric loops which are held below the latches on said plurality of needles, and means for operating said needle means and said loop-forming means.

16. An improved knitting mechanism as claimed in claim 15 further including means to feed a back loop yarn and wherein said loop-forming means comprise a plurality of front loop-forming sinker elements positioned outwardly from said plurality of needles and a plurality of back loop-forming dial jacks slidably mounted in a dial member positioned inwardly of said plurality of needles.

17. An improved knitting mechanism as claimed in claim 16 wherein each said front loop-forming sinker element has a front, middle and rear portion, said fabric lifting means comprising a raised projection on each front portion, said middle portion comprising a raised projection having at least front and top edges, said front edge being provided with a throat and said top edge being substantially at the level of the fabric in its raised position, said rear portion terminating in a butt.

18. An improved kniting mechanism as claimed in claim 16 wherein each of said back loop-forming a dial jacks has a forward portion which cooperates with said needles, said forward portion being formed with a top edge over which back loops are formed.

19. An improved knitting mechanism as claimed in claim 18 wherein said top edge of each of said dial jacks is stepped so as to provide a plurality of different levels wherein each of said levels forms a different height back loop.

20. The method of knitting terry cloth fabric on a row of latch needles which comprises the steps of knitting body loops substantially vertically, drawing out back terry loops substantially vertically, drawing out front terry loops substantially horizontally while simultaneously arresting opening of the needle latches, holding the latches in the arrested position at least during the drawing out of the front terry loops and interknitting the loops into the fabric.

21. In a method of knitting terry cloth fabric on a row of knitting needles provided with hooks and latches which comprises feeding back terry yarn on an upper level, feeding front terry yarn on a lower level and feeding body yarn between said back terry yarn and said front terry yarn, drawing out of the front terry yarn and the back terry yarn into front and back terry loops, respectively, and interknitting the yarns into a fabric and retaining the previously formed fabric loops on said needles below the latches, wherein the improvement comprises: arresting further opening of needle latches on said needles at least concurrently with the drawing out of the front terry yarn into front terry loops and holding the latch in its arrested position at least during the formation of the front terry loops.

22. In the method of knitting terry cloth fabric on a row of knitting needles provided with hooks and latches which comprises feeding back terry yarn on an upper level, lifting the fabric and feeding front terry yarn on a lower level and feeding body yarn between said back terry yarn and said front terry yarn, drawing out of the front terry yarn and the back terry yarn into front and back terry loops, respectively, and interknitting the yarns into a fabric and retaining the previously formed fabric loops on said needles below the latches, wherein the improvement comprises: arresting the opening of said latches prior to the raising of the fabric and the feeding of said front terry yarn and maintaining the latch in its arresting condition during the drawing out of the front terry yarn into front terry loops so that the loops forming the fabric which are retained on the needles below the latches are not severed during the drawing out of the front terry loops.

23. An improved method of producing terry cloth fabric from front loop, back loop and ground yarns on a knitting machine having a row of independent needles each having a stem, a hook and a latch, arresting jacks and cooperating front and back loop-forming sinkers, said sinkers being provided with throats on a plurality of different levels comprising the steps of:

advancing the needles upwardly so that previously formed fabric loops are moved down the stem of the needle below the latch, partially retracting the needles to a yarn-receiving position, positioning an arresting jack between the stem of the needle and the latch, retracting the front and back loop sinkers and coincidentally therewith raising said fabric so that the previously formed fabric loops retained on the needle stem are moved upwardly thereon, feeding a front loop yarn to the needles on top of the latches, advancing the front loop sinkers so that the front loop yarn is received in the throat of the front loop sinker thereby forming a front loop around the front loop sinker throat and the latches of adjacent needles, feeding a ground yarn to the needles, advancing the back loop sinker so that the nib of the back loop sinker is just inward of the row of needles, feeding a back loop yarn to the needles above said back loop sinker, retracting said needle and said arresting jack to draw out loops of the back loop yarn and interknitting the yarns into the fabric.

24. A method as set forth in claim 23 wherein the front loop yarn is fed from a position outside the row of needles and across the needle latch.

25. A method as claimed in claim 23 wherein only a ground yarn is fed at the next knitting station and comprises the additional steps of:

advancing the needles to a yarn-receiving position, retracting the back loop sinkers and feeding a ground yarn to the needles, advancing said back loop sinker to its knitting position and retracting the needle so that the previously formed loops retained on the needle stem raise closing the latch, thereby forming a new knitted loop composed solely of the ground yarn and advancing the front loop sinker to reform the front loop formed at the preceding feed so as to draw the front loop tightly into the fabric.

26. The method of knitting terry cloth on a row of needles which comprises the steps of:

feeding at a first feed a ground yarn on a first level, back terry yarn at a second level and front terry yarn on a lower level, drawing the front terry yarn into front terry loops and simultaneously arresting the full opening of the needle latches, drawing out a back terry yarn into back terry loops and interknitting said yarns into the fabric and at a succeeding feed feeding body yarn to the needles at said first level and knitting said ground yarn into the fabric while simultaneously reforming the front terry loop formed at the preceding feed so that the front terry loop will be drawn tightly into the fabric.

27. The method of forming terry cloth fabric which comprises the steps of:

forming a fabric on a row of latch needles and front and back loop forming sinkers at a first and second feed by advancing the needles and lifting the fabric, introducing a front terry yarn at the first feed below the level of the raised fabric, arresting the full opening of the latches adjacent the first feed, drawing out the front terry yarn below the fabric, introducing a body yarn to the needles at the first and second feeds, feeding a back loop yarn above the back loop-forming sinkers at the first feed, retracting the needles to draw out the back terry yarn and interknit back, front and ground yarn into the fabric at the first feed and knitting the ground yarn into the fabric at the second feed and advancing front loop sinkers adjacent the second feed so as to reform the front loops previously formed at first feed.

28. The method of forming double loop terry cloth fabric on a knitting machine having a row of needles each comprising a needle stem and a latch, cooperating sinkers positioned in a sinker dial member located outwardly of the needles where the sinkers are provided with a sinker throat, fabric lifting means, cooperating dial jack elements mounted in a dial member located inwardly of the needles and arresting jacks said method comprising the steps of:

placing the needles and sinkers at a yarn-receiving position;

positioning the arresting jacks so as to prevent the full opening of the needle latches, lifting the fabric so that a front loop yarn can be fed thereunder feeding a front loop yarn beneath the raised fabric into the needle latches;

advancing the sinkers to draw out the front loop yarn into front loops;

advancing the dial jack elements so that the forward edge of the dial jack elements extend outwardly of the circle of needles;

feeding a back loop yarn over the dial jack elements;

retracting the needles and concurrently therewith feeding a ground yarn to the needles below the dial jack elements; and drawing out the back loop yarn into a back loop and interknitting said yarns into the fabric.

* * * * *

UNITED STATES PATENT OFFICE

CERTIFICATE OF CORRECTION

Patent No. 3,977,216 Dated August 31, 1977

Inventor(s) Victor J. Lomardi et al.

It is certified that error appears in the above-identified patent and that said Letters Patent are hereby corrected as shown below:

Column 11, Line 33, delete "terey" and insert -- terry --.

Column 13, Line 43, delete "72" and insert -- 76 --.

Column 14, Line 8, delete "retractd" and insert -- retracted --;

Line 30, delete "111" and insert -- 131 --;

Line 33, delete "113" and insert -- 130 --;

Line 60, delete "132" and insert -- 131 --;

Line 62, delete "132" and insert --131 --;

Line 64, delete "not" and insert -- now --;

Line 66, delete "131" and insert -- 132 --.

Column 15, Line 4, delete "132a" and insert -- 131a --.

UNITED STATES PATENT OFFICE

CERTIFICATE OF CORRECTION

Patent No. 3,977,216 Dated August 31, 1977

Inventor(s) Victor J. Lomardi et al. Page 2 of 2

It is certified that error appears in the above-identified patent and that said Letters Patent are hereby corrected as shown below:

Column 16, Line 47, delete "elow" and insert -- below --.

Column 17, Line 33, delete "274" and insert -- 270 --.

Column 20, Line 62 (Claim 18) delete "a".

Signed and Sealed this

Twentieth Day of December 1977

[SEAL]

Attest:

RUTH C. MASON
Attesting Officer

LUTRELLE F. PARKER
Acting Commissioner of Patents and Trademarks